US011079207B1

(12) United States Patent
Burczynski

(10) Patent No.: US 11,079,207 B1
(45) Date of Patent: Aug. 3, 2021

(54) PLATED EXPANDING BULLET AND METHOD OF MANUFACTURING THE BULLET

(71) Applicant: Thomas J. Burczynski, Montour Falls, NY (US)

(72) Inventor: Thomas J. Burczynski, Montour Falls, NY (US)

( * ) Notice: Subject to any disclaimer, the term of this patent is extended or adjusted under 35 U.S.C. 154(b) by 0 days.

(21) Appl. No.: 17/073,490

(22) Filed: Oct. 19, 2020

Related U.S. Application Data

(60) Provisional application No. 62/938,043, filed on Nov. 20, 2019.

(51) Int. Cl.

| | |
|---|---|
| ***F42B 12/34*** | (2006.01) |
| ***F42B 12/78*** | (2006.01) |
| ***C25D 3/38*** | (2006.01) |
| ***B21K 21/06*** | (2006.01) |
| ***C25D 7/04*** | (2006.01) |
| ***F42B 12/74*** | (2006.01) |

(52) U.S. Cl.
CPC ..... *F42B 12/34* (2013.01); *B21K 21/06* (2013.01); *C25D 3/38* (2013.01); *C25D 7/04* (2013.01); *F42B 12/74* (2013.01); *F42B 12/78* (2013.01)

(58) Field of Classification Search
CPC ..... F42B 12/34
USPC ..... 102/507–510
See application file for complete search history.

(56) References Cited

U.S. PATENT DOCUMENTS

| | | | | |
|---|---|---|---|---|
| 219,840 A * | 9/1879 | Winchester | F42B 12/34 | 86/54 |
| 3,431,612 A * | 3/1969 | Darigo | B21K 1/025 | 86/55 |
| 4,882,822 A * | 11/1989 | Burczynski | F42B 12/34 | 86/54 |
| 5,079,814 A * | 1/1992 | Moore | F42B 12/34 | 102/509 |
| 5,943,749 A * | 8/1999 | Swank | B21K 21/06 | 86/54 |
| 6,935,243 B2 * | 8/2005 | Dippold | F42B 12/34 | 102/508 |

* cited by examiner

*Primary Examiner* — Reginald S Tillman, Jr.
(74) *Attorney, Agent, or Firm* — Bond Schoeneck & King, PLLC; George McGuire

(57) ABSTRACT

A fully plated hollow-point bullet and a method of manufacturing the bullet wherein a malleable metal precursor core having a central cavity and a surrounding wall is divided into a series of petals, each petal being separated from one another by an air space, and all interior and exterior surfaces of the precursor core, including individual petals, are thereafter electroplated with a second metal and final formed in a hollow-point pointing die, ultimately producing a more robust bullet and one that expands easier and faster on impact than plated bullets of conventional manufacture.

21 Claims, 12 Drawing Sheets

FIG. 8
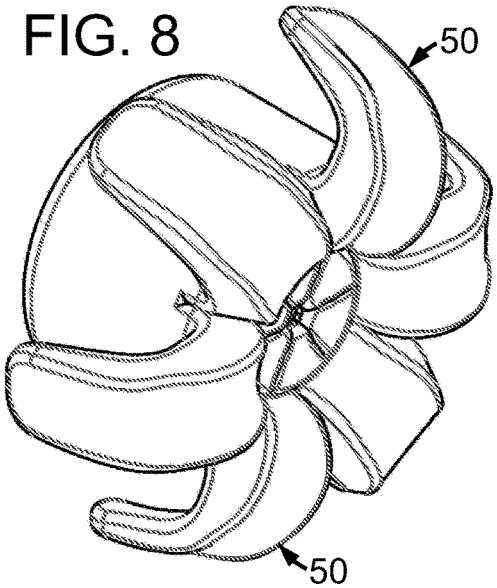
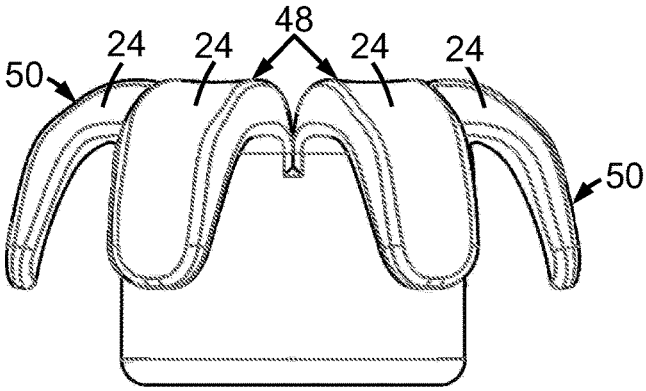
FIG. 9
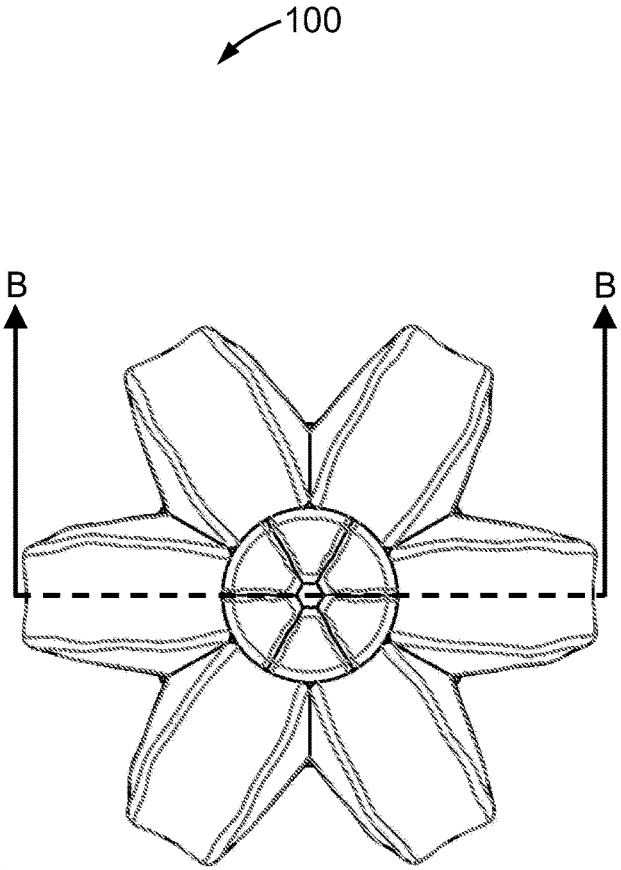
FIG. 10
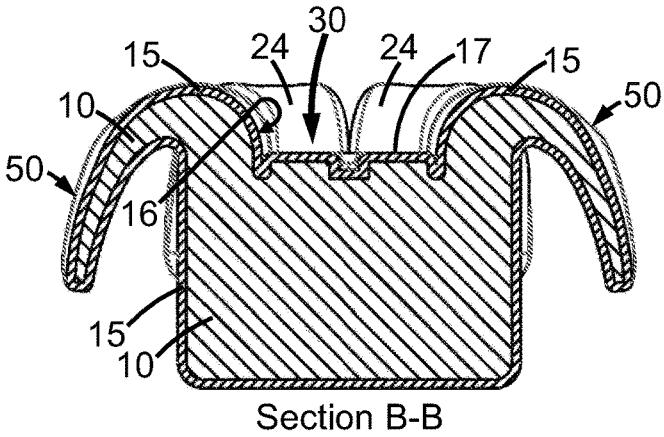
FIG. 11

PLATED EXPANDING BULLET AND METHOD OF MANUFACTURING THE BULLET

CROSS-REFERENCE TO RELATED APPLICATION

The present application relates and claims priority to U.S. Provisional Application No. 62/938,043 filed Nov. 20, 2019, the entirety of which is hereby incorporated by reference.

FIELD OF THE DISCLOSURE

The present disclosure relates generally to firearm ammunition, and more specifically, to a fully plated expanding bullet having a series of fully plated nose petals and a method of manufacturing the bullet. The bullet of the present disclosure exhibits more reliable expansion at low velocity, deeper penetration and better weight retention than prior art hollow-point bullets, especially when fired through intermediate barrier materials.

BACKGROUND

In the ongoing development of bullets for law enforcement use and other applications, emphasis across the ammunition industry has been placed on achieving reliable bullet expansion on impact, increased weight retention and optimal penetration into the intended target. Achieving these three goals in a balanced way has been challenging due to their oppositional relationship to one another. Examples: If a bullet doesn't mushroom (expand) to a sufficient diameter, it can penetrate too deeply. If a bullet loses portions of itself during impact, its ability to penetrate to a desired depth is reduced (i.e., insufficient target penetration due to a reduction in bullet mass). The challenges above extend to both conventionally jacketed bullets and plated bullets. Accordingly, it can be seen that a need exists for an improved bullet design that addresses these problems and ultimately achieves these goals in a balanced way. The present disclosure describes a plated bullet concept that overcomes the shortcomings and the related problems associated with prior art bullets.

RELATED ART

A conventional plated bullet comprises; a first metal, a malleable "core", generally comprising lead or lead-alloy, and a second metal, the plating or "jacket", generally copper, which is harder than the core material and serves as a substitute for a conventionally-made copper or copper-alloy "jacket" (e.g., a mechanically "drawn" jacket). The plating is applied to the core on a molecular level using the process of "electrodeposition". Electrodeposition is a metal deposition process in which positively charged metal ions in a chemical solution migrate under the influence of an electric field and are subsequently deposited over time onto the surface of an object (in this case, a bullet core) connected to a negatively charged electrode. The most common term used in the industry to describe this plating process is "electroplating". A plated bullet is one that has been "electroplated". The resultant coating of copper aggressively bonds to the surface of the lead core when an optimal chemical bath and a proper plating procedure is used. As the plating process continues, a buildup of copper is deposited onto the copper coating itself, layer upon layer, until the desired skin thickness ("plating thickness" or "jacket thickness") is achieved.

While the copper-to-lead bond is strong, the copper-to-copper bond is significantly stronger. The typical method used to plate bullets is known as "barrel plating". During the barrel plating process many bullet cores can be tumbled and plated at the same time inside a rotating barrel containing a chemical plating bath.

The most common conventionally plated bullet manufacturing process used to produce an acceptably efficient mushrooming or expanding bullet (e.g., a hollow-point bullet) entails copper plating the core of the bullet, then transferring the plated core to a die and punch station wherein a bladed tool forms a series of spaced slits, scores, skives, grooves or the like (for purposes herein, all of which can be collectively referred to as "intrusion features") in the plating of the nose area, and in some cases through the plating and into portions of the underlying core material. Whether the plating is breached to expose the core material or not, the resulting pre-form is transferred to another station where it is final formed in a profile die, commonly known as a "pointing die". The pointing die fully forms the nose of the bullet and can contain a hollow-point punch which forms a central cavity in the nose of the bullet. Although less terminally effective, other manufacturing approaches are more selective in that the intrusion features are formed in the plating either externally, on the outside of the nose, or internally, on the plated surface of the hollow-point cavity itself.

In the case of the most popular plated hollow-point bullet example (U.S. Pat. No. 5,079,814 (Moore, et al.), a conical bladed punch creates angled slits which breach the plating in the nose area of the core and, importantly, extend into only a portion of the underlying core material. These slits delineate a series of circularly-spaced, partially-formed "petals" having external plating. It is important to note at this juncture that the angled geometry of the conical punch blades leaves thick, un-cut or un-severed portions within the nose area of the core material which can only be torn apart or partially torn apart from one another during bullet impact with a fluid-based target if sufficient bullet velocity and energy are present. In order to tear these un-cut areas apart, an exceptionally high impact velocity is required—but sufficient velocity is not always achievable with inherently low velocity law enforcement cartridges or cartridges containing a heavier than normal weight bullet. The failure to tear these un-cut areas apart results in incomplete or insufficient bullet expansion—especially if an intervening target material such as fabric is encountered prior to impact with the intended target. It should be understood that, as a result of the manufacturing process used to form this and other prior art plated bullets utilizing intrusion features that breach the plating, the interior surface of the hollow-point cavity is predominantly un-plated, which exposes soft, bare core material to hard, intervening target materials. This soft, un-plated, unprotected inner area leaves core material susceptible to weight loss on impact as portions of the softer exposed material can be sheared, scraped or torn away—especially when penetrating hard, intervening targets such as automobile safety glass. When this occurs, the lightened bullet is unable to penetrate to the desired depth within the intended target.

Intervening target materials of the type used by the Federal Bureau of Investigation (FBI) in its ammunition test protocol, are known as "barrier materials". These barrier materials include heavy clothing, steel, wallboard, plywood and automobile glass. Hollow-point bullets depend to a great extent on fluid-based material entering the hollow-point cavity in order to expand hydraulically. Due to their dry nature, some barrier materials tend to plug the cavity of the hollow-point bullet which prevents the entrance of fluid-based materials as it penetrates the intended target. This plugging effect can severely limit bullet expansion, or prevent expansion altogether. Depending on the barrier material involved, if the cavity of a conventional hollow-point bullet is filled with barrier material before it reaches its intended target, it can over-penetrate or under-penetrate the intended target. For example, impact with wallboard can produce over-penetration as a result of minimal or no expansion, whereas impact with automobile glass invariably results in under-penetration due to bullet weight loss. Under-penetration, as it relates to the latter, is a result of the combined effect of; plugging, intervening target material hardness, and especially fractured glass shards shearing or scraping away portions of the softer, exposed core material. The loss of core material results in reduced bullet mass and momentum which subsequently results in insufficient penetration within the intended target.

In 1988, the Firearms Training Unit of the FBI developed the most stringent ammunition test protocol ever devised for evaluating the effectiveness of bullets. In its current, revised form, ammunition is tested in six different test events to evaluate a bullet's effectiveness. All of the tests ultimately entail the penetration of rectangular blocks of calibrated 10% ballistic gelatin. The block dimensions are 6.25 inches× 6.25 inches×16 inches in length. The first block is referred to as the "Primary Block". A "Stopper Block" can be placed behind the Primary Block in the event that a bullet penetrates farther than 16 inches. All shots are fired from a distance of ten feet from the muzzle of the firearm. The first test involves firing bullets into bare gelatin only. The remaining five tests entail firing bullets through intermediate barriers placed in front of the gelatin. These bullets continue on into the Primary Block of gelatin. In some cases the bullets over-penetrate and enter the Stopper Block.

The FBI barrier tests include the following materials: Heavy Clothing (four layers of T-shirt material, and one layer each of Polartec fleece, cotton shirt material and denim); Sheet Steel (two pieces of 20 gauge hot-rolled steel); Wallboard (two pieces of ½ inch standard gypsum board); Plywood (one piece of ¾ inch "AA" fir plywood); Automobile Glass (one piece (15"×18") of A.S.I. ¼-inch laminated automobile safety glass set at an angle of 45° to the horizontal and 15° to the side, resulting in a compound angle)). Of the five barrier tests, the automobile glass test causes the most damage to the bullet as fractured glass shards can shear or scrape away large portions of the soft, exposed core material comprising the wall of the hollow-point cavity—and in some cases, even portions of the mid-core area. This damage occurs in both conventionally plated bullets and conventionally-jacketed bullets, and greatly reduces the bullet's ability to penetrate to the desired depth within the Primary Block due to core weight loss. The compound angle of the glass surface exacerbates bullet damage in that it exerts extreme stress and pressure on one side of the bullet nose. Ammunition companies have been attempting to overcome the problem of bullet weight loss and under-penetration during impact with automobile glass for decades.

In addition to undesirable terminal ballistics, the reason under-penetration and over-penetration are problematical for manufacturers is because each can adversely affect a bullet's "test score" based on the FBI's 500 point scoring system. The FBI's minimum penetration requirement is 12 inches, regardless of the barrier material involved. Bullet penetration depths between 12.0 inches and 16.0 inches are rewarded while under-penetration and penetration over 18.0 inches are penalized. A low FBI score generally removes a competitor from the list of companies seeking an ammunition contract with the agency.

Various attempts have been made over the years to design a plated bullet that can substantially outperform conventionally-made jacketed bullets with regard to terminal ballistics. These efforts have been met with a degree of success as well as a host of failures. There are many factors involved in designing effective plated bullets, especially those for law enforcement use due to the stringent nature of the FBI barrier test protocol. In spite of decades of experimentation and change, even the best plated bullet marketed today suffers from a number of shortcomings. Some of the shortcomings associated with common approaches to plated bullet design will become apparent after reviewing the prior art examples below.

U.S. Pat. No. 5,079,814 (Moore, et al.) describes a manufacturing method used to form a plated hollow-point bullet wherein a precursor core having a hemispherical shape at its nose end is plated, then transferred to a die and punch station wherein a conical bladed punch penetrates the nose, slitting limited portions of the plating and limited portions of the underlying core material which results in thick, un-cut or un-severed areas within the wall surrounding a central, undulating cavity comprising a series of sharp-edged, tapering ribs. The thick, un-cut areas within the wall are areas lying adjacent partially formed petals. The punching process leaves exposed lead within the cavity. It is important to point out that these areas remain partially severed even after final forming the bullet in a profile die (pointing die). The slit precursor is then transferred to another station where it is final formed in a hollow-point pointing die. The final formed bullet has exposed lead within the hollow-point cavity. The ammunition utilizing this bullet is available to law enforcement agencies. Despite its terminal ballistic limitations, it is currently the most popular plated bullet available. Again, like all conventional hollow-point bullets, it too, depends on fluid entering the hollow-point cavity in order to expand hydraulically. And, like all hollow-point bullets, this bullet's expandability can be compromised when fabric and/or dry, intermediate barriers such as wallboard and plywood are encountered since the hollow-point cavity tends to "clog" or "plug up" with these materials. In short, the "plug" of dry material severely limits or fully negates the hydraulic effect which adversely affects the expandability of the bullet. The thick, un-cut, hard-to-bend core portions within the nose of the Moore, et al bullet contribute further to the expandability problem mentioned above due to the inherent wall strength afforded by these stronger portions of core material and un-cut plating. As alluded to above, sufficiently deep target penetration is a primary goal of the FBI—and the Moore, et al bullet is not exempt from the ravages of core weight loss when impacting glass because its interior cavity wall, like conventional hollow-point bullets, is un-plated—and therefore unprotected.

U.S. Pat. No. 3,431,612 (Darigo) describes a plated bullet which utilizes a series of external, longitudinal grooves in the plating at the nose end of the projectile which tend to cleave these areas and assist in opening up the front end of the projectile upon impact. The grooves do not breach the plating. The Darigo patent does not mention the formation of petals prior to or after bullet impact.

U.S. Pat. No. 6,935,243 (Dippold) describes a plated hollow-point bullet wherein the plating completely covers an undivided hollow-point core. A series of longitudinal grooves are formed on the interior surface of the plating inside the nose cavity which do not breach the plating and do not rupture the plating until after the bullet impacts a soft target, at which point the cavity wall is expected to expand radially as it tears along the grooved areas. It should be understood that, when successful, this tearing action will result in the formation of a series of "impact petals" which will expose adjacent portions of bare core material (material lying between neighboring petals) to the target. To further clarify, prior to bullet impact, the core material portion of the cavity wall of the Dippold bullet is continuously solid and uninterrupted in that there are no split or divided areas present within the core material itself.

With respect to the three prior art bullets cited above, it should be understood that a substantial amount of impact velocity and energy is required to split both the plating and the underlying core material. In short, impact energy is 'wasted' splitting the plating prior to splitting the core material—energy that could otherwise be used to facilitate bullet expansion at a lower impact velocity.

SUMMARY OF THE INVENTION

This invention relates generally to improvements to plated bullets, and more specifically to plated hollow-point bullets. According to one embodiment, the plated, hollow-point bullet comprises a malleable core completely surrounded by a bonded metal jacket having a series of individually plated, circumferentially spaced petals at its nose end and a fully plated hollow-point cavity in said nose end in which no core material is exposed. The individually plated petals are a result of starting out with a cylindrical precursor core having a central cavity at one end surrounded by a continuous, uninterrupted wall which is thereafter divided into a series of circumferentially spaced petals prior to fully plating the divided precursor core. The divided precursor core is then fully plated and reformed in a hollow-point pointing die. The plating in the final bullet has a hardness greater than the underlying core material. Each petal of underlying core material is completely covered and individually encapsulated by a contiguous "shell" of plating which shell also includes the balance of the bullet's internal and external surfaces. This atypical plating geometry results in a much more robust bullet having a distinctive appearance and one that not only expands easier and faster than a conventionally plated bullet upon target impact due to its pre-separated, unrestrained and independently-bendable petals, but can also retain 100% of its mass without revealing exposed core material after direct impact with a fluid based target. This bullet also performs consistently and exceptionally well during penetration of FBI barrier materials since its plated hollow-point interior serves as a shield to protect the softer, underlying core material from weight loss due to the shearing effects caused by collision with barrier materials such as windshield glass.

In one preferred embodiment, the bullet has an aft portion with a generally cylindrical sidewall, and a fore portion with a tapering sidewall (the ogive) extending towards the front end of the bullet, and a central recess (hollow-point cavity) in its front end. The hollow-point cavity can be of any shape desired. For example, cylindrical, spherical, frusto-conical, conical or combinations of these geometries. The preferred hollow-point cavity shape starts out as substantially cylindrical at its open end then transitions into a substantially curved or spherical shape as it approaches the bottom of the hollow-point cavity. The shape of the cavity at its terminus can be truncated or flat if desired (e.g., a truncated hemisphere). An inlet area near the extreme front of the hollow-point cavity (adjacent the rim) can comprise a small radius or beveled area if desired to help promote initial bullet expansion on impact.

The plating which surrounds all interior and exterior surfaces of the final bullet can be any thickness desired. The plating covering large areas of the bullet is generally consistent in thickness but certain smaller areas, or intersecting areas between features (e.g., at the base of the petals) can vary in thickness. The plating thickness in these areas depends primarily on the initial size and shape of the edges and corner radii along various areas of the divided precursor core prior to plating. The plating thickness in these areas is dictated by the nature of the electroplating process itself. For example, if a feature in a plated part has a sharp edge, or a sharp inside or outside corner, the plating thickness can vary in these specific areas. A sharp outside edge or outside corner will tend to have thicker plating (an extra buildup of plating), whereas an inside corner or a recess will have thinner plating. This variation in plating thickness can be mitigated to a great extent by designing a pre-plated part to include a radius along any areas that might have a sharp edge. In critical areas, a radius will be found in the divided, pre-plated precursor core. The design of the bullet of the present disclosure is such that variations in plating thickness in these non-radius'd areas does not affect the bullet's terminal performance on impact.

The present disclosure further relates to an unorthodox method of making the fully plated hollow-point bullet described above in which a solid, cylindrical core is placed in a cylindrical die containing a cavity-forming/knockout punch and then swaged to create a cylindrical core having a central cylindrical cavity and a continuous surrounding wall at one end; the core with cavity is then transferred to another station where the core is urged into another cylindrical die containing a knockout punch and a multi-armed dividing insert which divides the wall in the open end of the core. This results in the formation of a series of circumferentially-spaced petals within the wall area, each petal being separated by a longitudinal air space; the divided core is then fully plated and then transferred to a hollow-point profile die containing a hollow-point-forming/knockout punch where it is swaged into its final configuration. This last step causes various portions of each plated petal to either narrow or "inflate" to a uniform size as the core material flows and is rearranged within the encapsulating plating. This internal rearrangement of core material is due to the combined effect of the tapered geometry in the profile die and the internal opposition provided by the hollow-point-forming/knockout punch. During this rearrangement process, a thickened portion in the lower extremity of each petal is produced which provides additional strength that is beneficial with respect to overall bullet expansion characteristics. The additional strength provided in this area is particularly important when the bullet impacts hard, abrasive intermediate barriers such as windshield glass. These thickened areas are formed when the plated precursor is forced deep into the tapered end of the profile die which causes the lower portion of each petal to swell and grow in width and thickness as it assumes the outside shape of the tapered tip portion of the hollow-point-forming/knockout punch. At the same time this is occurring, the petals are forced to converge inwardly until each petal is at least in partial contact with adjacent petals. Intermediate processing steps may be incorporated in the manufacture of the bullet such as; chemically cleaning the core, tumbling the core to smooth stepped areas and/or create radii or enlarge existing radii, polishing the plated bullet, and applying anti-corrosion materials to the surface of the finished bullet.

According to an embodiment the plated expanding bullet comprises a core comprising a malleable material of a first hardness, the core having a nose and an aft; a plurality of petals at least partially defining the nose of the core, wherein each petal is integrally formed and extending from a peripheral portion of the aft and taper inward such that the plurality of petals form a hollow-point cavity, each of the petals is independently bendable, each of the petals further comprising a first inflection point and a second inflection point wherein the second inflection point is positioned closest to the aft and is the thickest portion of the petal; and a bonded metal jacket of a second hardness completely encapsulating the core, each of the petals, and the hollow-point cavity and wherein the second hardness is greater than the first hardness.

According to an aspect the hollow-point cavity is frustoconical.

According to an aspect the hollow-point cavity is cylindrical at a first end and curved at a second end.

According to an aspect wherein the aft comprises a base, wherein the base is truncated.

According to an aspect wherein the aft comprises a base, wherein the base is flat.

According to an aspect the core comprises between three and eight petals.

According to an aspect the jacket thickness being between 0.0035 inches and 0.030 inches.

According to an aspect the core being made of lead or lead alloy.

According to an embodiment the plated expanding bullet comprises a core comprising a malleable material of a first hardness, the core having a nose and an aft; a plurality of petals at least partially defining the nose of the core, wherein each petal is integrally formed and extending from a peripheral portion of the aft and taper inward such that the plurality of petals form a hollow-point cavity, each of the petals is independently bendable, each of the petals further comprising a first inflection point and a second inflection point wherein the second inflection point is positioned closest to the aft and is the thickest portion of the petal; and a bonded metal jacket of a second hardness completely encapsulating the core, each of the petals, and the hollow-point cavity and wherein the second hardness is greater than the first hardness, further wherein the jacket comprises a first thickness and a second thickness.

According to an aspect the hollow-point cavity is frustoconical.

According to an aspect wherein the aft comprises a base, wherein the base is truncated.

According to an aspect the petals further comprise a base, and wherein the jacket encompassing the base of the petals is a second thickness.

According to an embodiment the process for forming a plated hollow-point expanding bullet comprises forming a cylindrical core having a central cylindrical cavity and a continuous surrounding wall at one end from a cylindrical core using a cavity-forming/knockout punch; swaging the cylindrical core to form a series of circumferentially-spaced petals in the wall of the core wherein each petal using a petal-forming die containing a multi-armed dividing insert while simultaneously separating the petals by a longitudinal air space; electroplating all internal and external surfaces of the divided pre-form; and forming the plated pre-form into a plated hollow-point expanding bullet with plating completely encasing all internal and external surfaces.

According to an aspect the process further comprising the step of alternatively forming a cylindrical core having a central cylindrical cavity and a continuous surrounding wall using an injection mold.

According to an aspect the process further comprising the step of alternatively forming a cylindrical core having a central cylindrical cavity and a continuous surrounding wall using a gravity cast.

According to an aspect the process further comprising the step of chemically cleaning the core.

According to an aspect the process further comprising the step of tumbling the core to smooth stepped areas and/or create radii or enlarge existing radii.

According to an aspect the process further comprising the step of tumbling the bullet to polish its surface.

According to an aspect the process further comprising the step of coating the bullet surface with an anti-corrosion material.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In the drawings:

FIG. 8 is a perspective view of the fully plated bullet showing the individually curved petals after it has impacted a fluid-based target and has expanded in diameter.

FIG. 9 is a side elevational view of the expanded bullet of FIG. 8 showing the individually curved petals with plating still intact after it has impacted a fluid-based target and has expanded in diameter.

FIG. 10 is an end view of the expanded bullet looking down into the lower portion of the expanded hollow-point cavity.

FIG. 11 is a section taken along line B-B of FIG. 10 showing a longitudinal cross-sectional view of the bullet showing the encapsulating plating still intact and still attached securely to all internal and external surfaces of the core.

DETAILED DESCRIPTION OF THE DISCLOSURE

Figure 1:
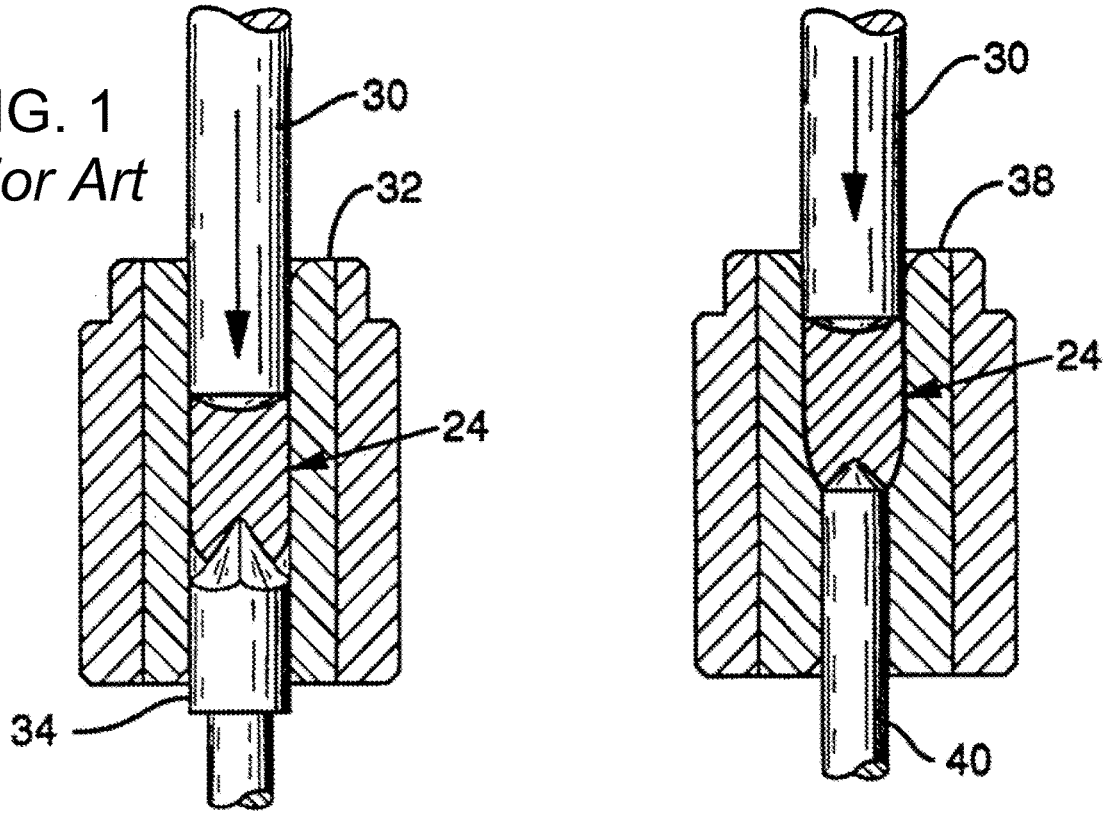
FIG. 1 Prior Art
FIG. 1 is a view partly in section and partly in elevation showing the dies and punches used in a typical prior art manufacturing process wherein a plated core held in a first die is slit using a bladed punch, then transferred to a second die containing a hollow-point-forming/knockout punch and final formed. This process ultimately results in an externally plated hollow-point bullet.
Figure 1:
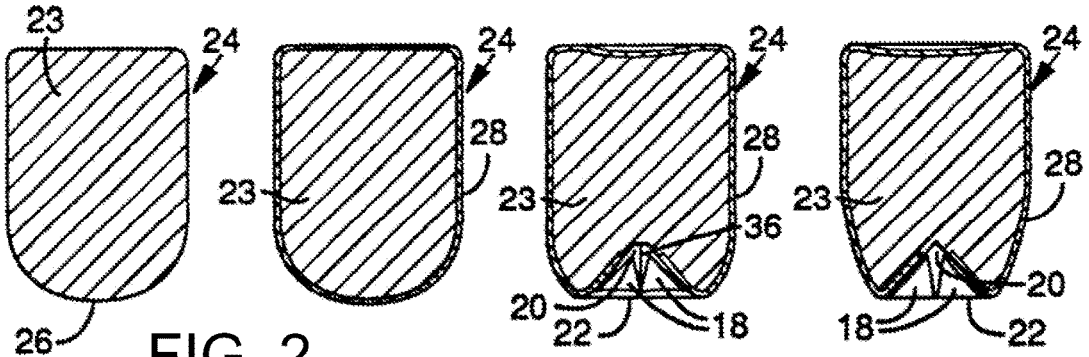
FIG. 1 Prior Art
Figure 2:
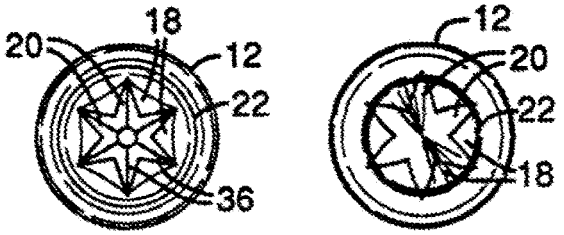
FIG. 2 Prior Art
FIG. 2 is a view partly in section and partly in end elevation collectively showing the individual steps involved in the prior art manufacturing process shown in FIG. 1 and the plated core and plated bullet resulting therefrom. The steps shown in the longitudinal cross-sectional views include an un-plated core having a solid, hemispherical nose, the plated core, the plated core after it has been slit by a conical bladed punch, and the fully formed, externally plated hollow-point bullet. Also shown are two views in end elevation; the first looking down into the hexagonal cavity of the slit, plated core and the second looking down into the hollow-point cavity of the finished plated bullet.

The embodiments of the invention and the various features thereof are explained in detail with reference to the non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings unless otherwise noted.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the invention.

Figure 3:
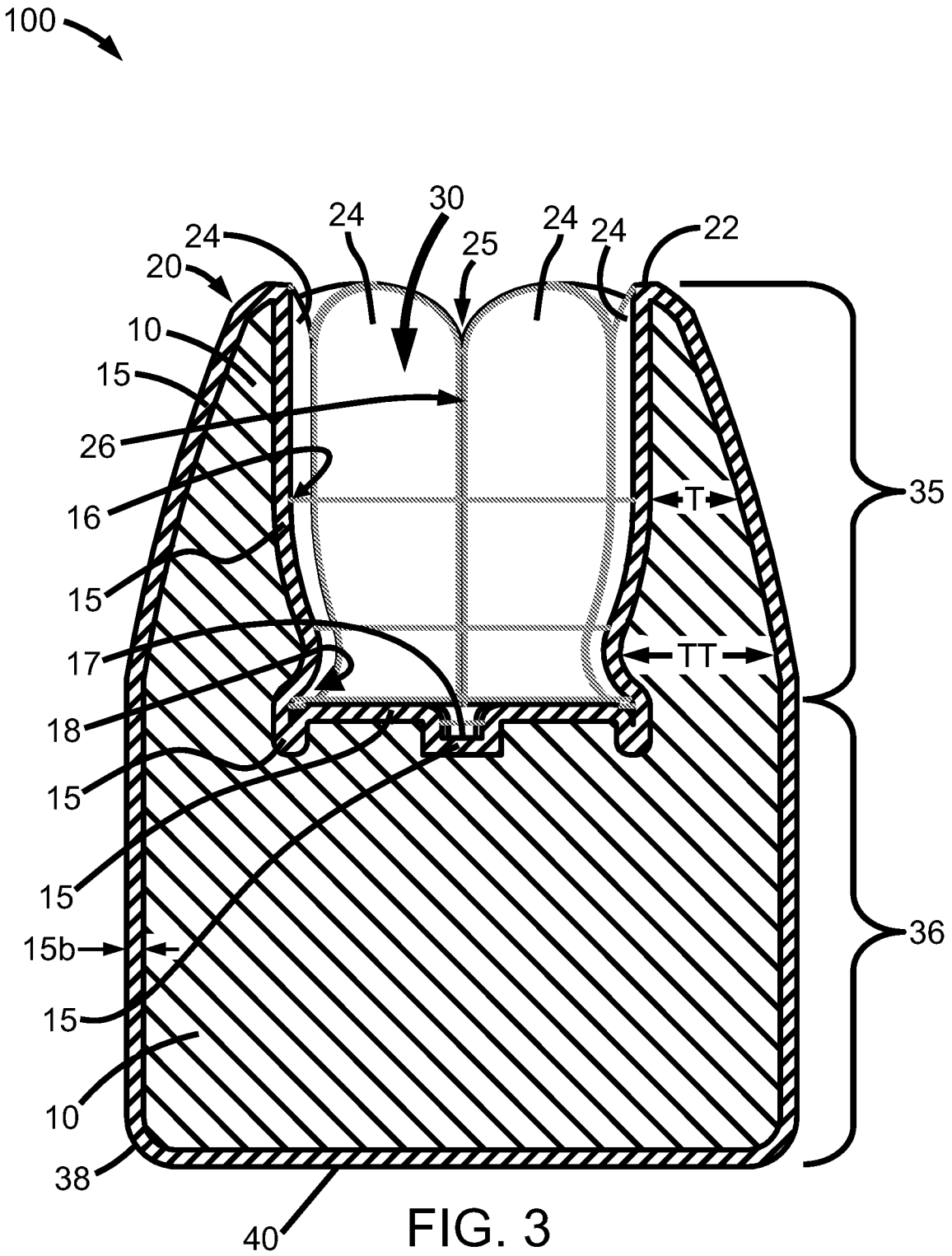
FIG. 3 is a longitudinal cross-sectional view of the finished, fully plated hollow-point bullet of the present invention showing how the core material is completely encapsulated by plating, including the individually plated petals and the plated interior of the hollow-point cavity.

A preferred embodiment of a plated bullet constructed according to the principles of the present invention is indicated generally as 100 in FIG. 3. FIG. 3 is a longitudinal cross-sectional view of the plated bullet 100 of the present invention showing its cylindrical rear portion 36 (which can also be referred to herein as the bullet's "shank") and a tapered front portion or "ogive" 35 at its "nose" 20 end. The nose 20 of the bullet 100 as used herein indicates a general tapered area near the front of the bullet which can contain a central hollow-point cavity 30. The bullet 100 has a base 40 which can be flat as shown or can have a concavity (not shown), and a radius at the heel 38 of the base 40. The bullet 100 has a core 10 of malleable metal (which can also be referred to as "core material" herein) and a plated metal skin or "jacket" 15, preferably comprising copper or copper alloy. In the example shown in FIG. 3, a plating thickness 15*b* of about 0.010 of an inch has been added to all internal and external surfaces of the core 10. The preferred core 10 material is lead or lead alloy (e.g., lead-antimony). The core 10 can be "pure" lead (i.e., lead, including any trace elements) or lead alloy. If a lead alloy is used for the core 10 to harden and strengthen it, the preferred alloying element is antimony. The percentage of antimony in the core 10 can vary from 0.25% to 6.0%. As an environmentally friendly alternative to lead or lead-alloy, the core 10 can comprise essentially heavy metal free elements such as tin, zinc or bismuth or alloys of any of these or other lead-free elements.

The plating comprising the jacket 15 is harder than the underlying malleable core 10. The Jacket 15 completely surrounds and encapsulates all internal and external surfaces of the malleable core 10. Said encapsulation includes adjacent petal 24 surfaces that have converged and are in intimate contact with one another. The convergence of petals 24 is represented here by parting line 26 (three of six such parting lines are shown in the FIG. 3 example). It is important to note at this juncture that the total encapsulation of the individual petals 24 highlights a major difference between the bullet 100 of the present invention and prior art plated hollow-point bullets. The plated jacket 15 thickness (per side) can vary depending on caliber and the ultimate use to which the bullet 100 is put. The minimum jacket 15 thickness is 0.0035 of an inch. The preferred minimum jacket 15 thickness is 0.010 of an inch. The maximum jacket 15 thickness can be as much as 0.030" of an inch.

A leading edge or rim 22 at the nose 20 end of the bullet 100 encircles the central hollow-point cavity 30. The hollow-point cavity 30 is present in the general nose 20 area of the bullet 100. The hollow-point cavity 30 doesn't have to be as deep or deeper than the ogive 35 is long. Its depth can span only part of the ogive's 35 length if desired. The hollow-point cavity 30 can have various dimensions and can comprise various shapes—for example; cylindrical, spherical, frusto-conical, conical or combinations of these geometries. The preferred hollow-point cavity 30 shape starts out substantially cylindrical (minus any draft necessary) at its open end as shown, then transitions into a substantially curved or spherical shape. This transitioned area starts on the interior surface 16 of the jacket 15 adjacent "T" and extends to area "TT" where it achieves its apex as it approaches the bottom 17 of the cavity 30. In the example shown in FIG. 3, the transitioned area essentially follows the general outline of a truncated hemisphere.

As the bullet 100 is being final-formed in a hollow-point pointing die 90 (FIGS. 36, 37), swaging pressure causes the petals 24 of the plated precursor 100D (FIGS. 24-27) to change shape as they conform to the ogive-forming area 90*b* of the profiled cavity 90*a* of the threaded pointing die 90, and around the profiled end 91*a* of the hollow-point-forming/knockout punch 91. During this process, core 10 material migrates and is rearranged within the encapsulating jacket 15 as it flows in a wavelike manner from one area to another (from the bullet 100 nose 20 towards the cylindrical rear portion 36 or shank area). At the same time this is occurring, the petals 24 are forced to converge inwardly until each petal 24 is at least partially in contact with adjacent petals 24 lying on either side. This reformation process causes each jacketed petal 24 to narrow in thickness in areas lying between the rim 22 at the nose 20 end of the bullet 100 and the inflection point at "T" of the hollow-point cavity 30 and to swell in size and thicken at an area shown in FIG. 3 as "TT" which lies below T and slightly forward of the bottom 17 of the hollow-point cavity 30. This thickened area TT is substantially thicker than T and provides additional petal 24 strength. This is beneficial with respect to overall bullet robustness and expansion characteristics, and especially beneficial when impacting hard barrier materials.

To elaborate further, the petal 24 thickness at TT is formed as swaging pressure forces the core 10 material to widen and flow radially inwardly, along with its bonded jacket 15, towards the axis of the bullet 100 and into contact with at least a portion of the tapered tip 91*a* (FIG. 37) of the hollow-point-forming/knockout punch 91. At the same time TT is formed, a wider, internal peripheral area 18 (i.e., a circular air space) is formed at the lower extremity of each petal 24 below TT and above the bottom 17 of the hollow-point cavity 30. This internal peripheral area 18 forms due to the inherent 'folding limit' associated with the strength and malleability of the harder jacket 15 material. Because of this folding limit, the internal jacket 15 surface 16 is, in some cases (e.g., in the case of a thick jacket 15), unable to fully conform to that portion of the hollow-point-forming/knockout punch 91 profile nearest its terminus 90*c*. In some cases, the opposing jacket 15 surfaces 16 lying between TT and the bottom 17 of the hollow-point cavity 30 can be in direct contact with one another. This can occur, for example, as a result of a thin jacket 15 combined with a soft, pure lead core 10. The internal peripheral area 18 serves a terminal ballistic function during bullet 100 expansion on impact since it forms an undercut in the petal 24 wall 77 (FIG. 27) which lies beneath the thicker TT area. The petal 24 wall 77 below the internal peripheral area 18 is thinner and weaker than the thickened TT area. In this condition, the weaker petal 24 wall 77 lying below TT allows the entire length of the petal, including the thick TT area, to bend easier and faster upon target impact. The strength benefit provided by the thickened TT area is substantially retained as the bullet expands within a target, since its vertex is oriented face-forward. The additional strength provided in the thickened TT area is particularly important when impacting hard, abrasive intermediate barriers such as windshield glass.

An initial inlet area (not shown) near the extreme front of the hollow-point cavity 30 (immediately adjacent the rim 22 on the cavity's 30 interior surface 16) can comprise a small radius or chamfered area (not shown) if desired to help initiate low velocity bullet 100 expansion upon target impact. The boundary of the rim 22 can be of an undulating geometry—scalloped as shown or relatively flat. The scalloped appearance as shown in FIG. 3 is due to a mild radius that exists at the leading edge of the rim 22 of each petal 24—the result of a preceding core displacement/petal forming step (which forms 100B shown in FIGS. 16-19). In the case of a scalloped geometry, a cleaved area 25 is formed by each pair of tightly-grouped petals 24. The plated copper (or copper alloy) jacket 15 completely surrounds and encapsulates internal and external surfaces of the malleable core 10, including the interior surface 16 of the hollow-point cavity 30, the bottom 17 of the hollow-point cavity 30, and importantly, all areas between adjoining petals 24. It should be noted that the finished bullet 100 can have as few as three petals 24 or as many as eight or more. The optimum number of petals 24 in the bullet 100 for most law enforcement applications is typically six.

It is important to note that preliminary, intermediate and/or post-processing steps may be incorporated into the manufacture of the bullet 100, such as; tumbling the bare core formations to smooth stepped areas, create radii, enlarge existing radii, chemically cleaning the cores prior to plating, polishing the plated bullet 100, and applying anti-corrosion materials to the surface of the finished bullet 100.

Figure 4:
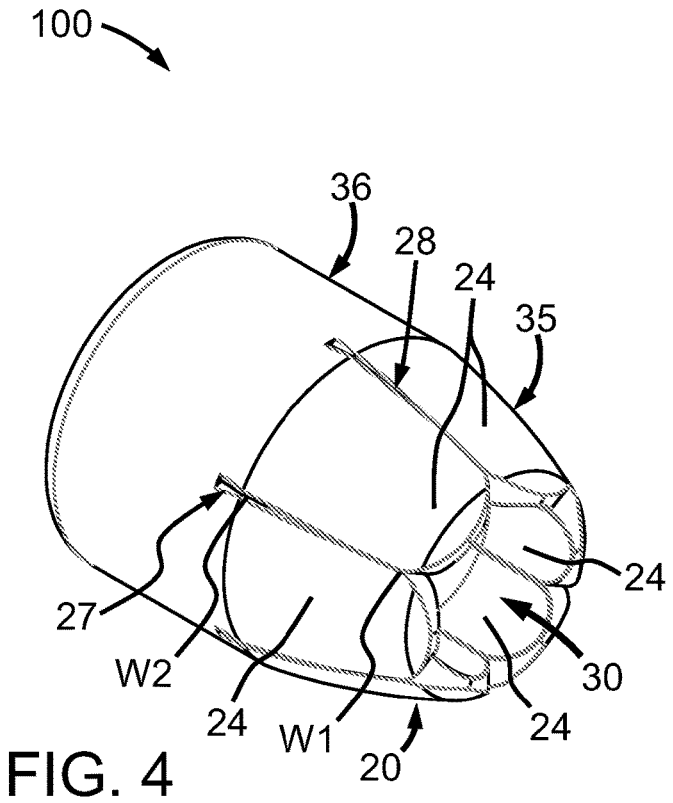
FIG. 4 is a perspective view of the finished, fully plated bullet shown in FIG. 3 showing the individually plated petals in contact with one another and the hollow-point cavity in the nose end of the bullet.
Figure 5:
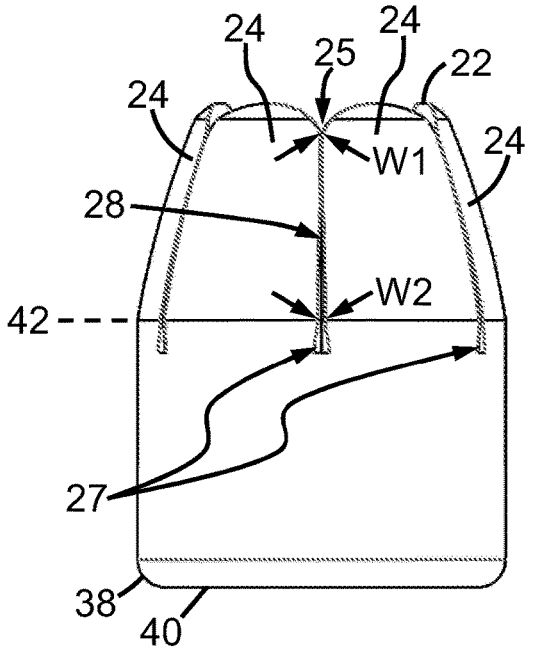
FIG. 5 is a side elevational view of the profiled bullet oriented vertically.

FIG. 4 is a perspective view of the finished, fully plated bullet 100 of FIG. 3 showing the hollow-point cavity 30 in the nose 20 end of the bullet 100 and the individually plated petals 24 in direct contact with one another. The petals 24 can terminate at, rearward of, or forward of the inflection point 42 which exists at the juncture of the ogive 35 and the shank 36 of the bullet 100. A series of short, longitudinal, triangular-shaped impressions or "pleats" 27 exist at spaced locations about the forward shank 36 area of the finished bullet 100 (as shown) but can, if desired, commence at, rearward of, or forward of the inflection point 42 (FIG. 5). The pleats 27 are formed as a natural consequence of an inward folding action as the petals 24 of the plated precursor 100D converge when they are forced into a tapered pointing die 90 (FIGS. 35-37) during the formation of the ogive 35 of the finished bullet 100. The pleats 27, while aesthetically pleasing, serve no critical function. The centerline or valley area of each external pleat 27 is substantially aligned with internal parting line 26 (FIG. 3 and FIG. 7).

FIG. 5 is a side elevational view of the profiled bullet oriented vertically showing a longer, narrower series of triangular-shaped impressions 28 on the exterior of the ogive 35 that run nearly the entire length of adjoining petals 24, which gives the bullet 100 a distinctive look. Each triangular-shaped impression 28 is analogous to parting line 26 (shown in FIG. 7). Each triangular-shaped impression 28 has a centerline or valley area which is connected to that of an aligned pleat 27. The centerline or valley area of each triangular-shaped impression 28 is essentially a continuation of the centerline or valley area of each corresponding pleat 27. To further clarify, the centerline or valley area of each triangular-shaped impression 28 is substantially aligned with parting line 26 (FIG. 7), as well as with the centerline or valley area of pleat 27. The triangular-shaped impressions 28 are formed by opposing plated surfaces of adjoining petals 24. Each opposing surface of the triangular-shaped impressions 28 comprises a long, tapered radius of diminishing size and area as the opposing surfaces approach the nose 20 end of the bullet 100. The opposing surfaces comprising the triangular-shaped impressions 28 are of greater width at W2 and are of lesser width at W1. An attendant tapered air space separates the opposing surfaces over a portion of the petal 24 length and diminishes in width as it nears the nose 20 end of the bullet 100 until petal-to-petal contact is made at or below the cleaved area 25. The proximity of the opposing surfaces to one another depends on the core 10 hardness, the plating 15 thickness, and the degree of swaging pressure achieved within the pointing die 90 as the ogive 35 of the finished bullet 100 is formed.

Figure 6:
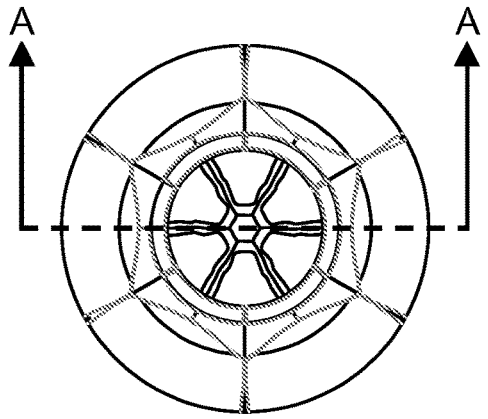
FIG. 6 is an end view of the bullet looking down into the hollow-point cavity in its nose.

FIG. 6 is an end view of the bullet 100 looking down into the hollow-point cavity 30 in its nose 20.

Figure 7:
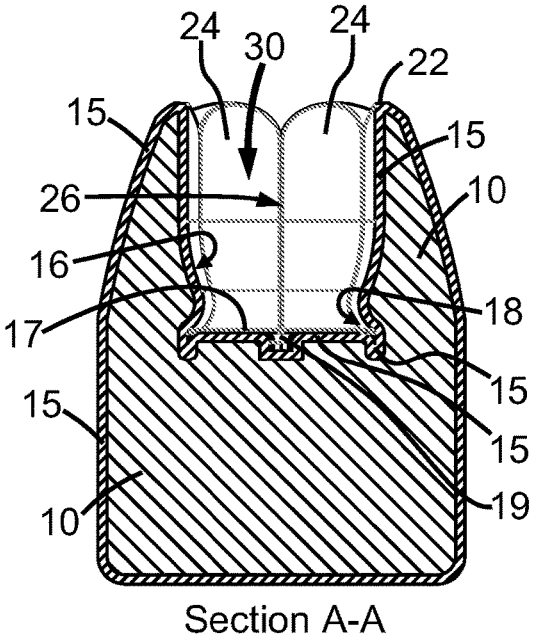
FIG. 7 is a section taken along line A-A of FIG. 6 showing a longitudinal cross-sectional view of the bullet.

FIG. 7 is a section taken along line A-A of FIG. 6 showing a longitudinal cross-sectional view of the plated bullet 100. FIG. 7 shows the geometric shape and features of the bullet 100 shown in FIG. 3 and is included here mainly to show the relationship between internal parting line 26 and the external, triangular-shaped impression 28 shown in FIG. 5. The triangular-shaped impression 28 shares the same axial centerline as parting line 26. The main difference between the two surface geometries (internal vs. external) is the width separating opposing surfaces. The opposing surfaces of internal parting line 26 are generally in closer proximity to one another, but are also substantially parallel, and each surface comprises a smaller radius of a more consistent size and area along its length than that of the opposing surfaces of the external triangular-shaped impression 28. In contrast, the opposing surfaces of the external triangular-shaped impression 28 are inclined away from one another, the separation being greatest in the aft area of the ogive 35 at W2. Each opposing surface of the triangular-shaped impression 28 also exhibits a long, tapered radius of diminishing size and area as the opposing surfaces approach the nose 20 end of the bullet 100 until petal-to-petal contact is made at W1 or at a point rearward of the cleaved area 25.

FIG. 8 is a perspective view of the fully plated bullet 100 showing the individually curved petals 50 after it has impacted a fluid-based target and has expanded in diameter.

FIG. 9 is a side elevational view of the expanded bullet 100 of FIG. 8 showing the individual petals 24 and the petal curvature 50 with plating still intact after it has impacted a fluid-based target and has expanded in diameter. It is important to note that the forwardmost or leading surfaces 48 of the bullet 100 jacket 15 take the brunt of bullet impact when colliding with barrier materials, especially windshield glass, thereby effectively protecting the underlying core 10 material—which, again, represents a major difference between the bullet 100 of the present invention and prior art plated bullets.

FIG. 10 is an end view of the expanded bullet 100 looking down into the lower portion of the expanded hollow-point cavity 30 (i.e., what remains of the hollow-point cavity 30). Unlike prior art bullets, because the petals 24 of the bullet 100 are not attached to each other in any way, and there is no jacket-tearing and/or or core-tearing action involved on impact, the petals 24 are allowed to freely swing away from one another in an unrestricted manner during the bullet 100 expansion process upon target impact. This unrestricted freedom of movement allows the bullet 100 to expand fully at substantially lower impact velocity than prior art bullets—whether said prior art bullets are conventionally jacketed or plated. This last point provides a major advantage to law enforcement agencies as many of the duty weapons carried are short barreled (therefore producing low muzzle velocity) and/or compact, inherently low-velocity backup weapons such as the .380 Auto. Depending on muzzle velocity, core 10 hardness, and jacket 15 thickness, the bullet 100 of the present invention can expand to a diameter between 50% and 100% or more of its original, unexpanded diameter.

FIG. 11 is a section taken along line B-B of FIG. 10 showing a longitudinal cross-sectional view of the bullet 100 and the encapsulating jacket 15 plating still intact and still securely attached to all surfaces of the core 10 after impacting a fluid-based target. An all-encompassing jacket 15 (and the unorthodox manufacturing process described below) distinguishes and sets the bullet 100 of the present invention apart from prior art plated bullets.

Figure 12:
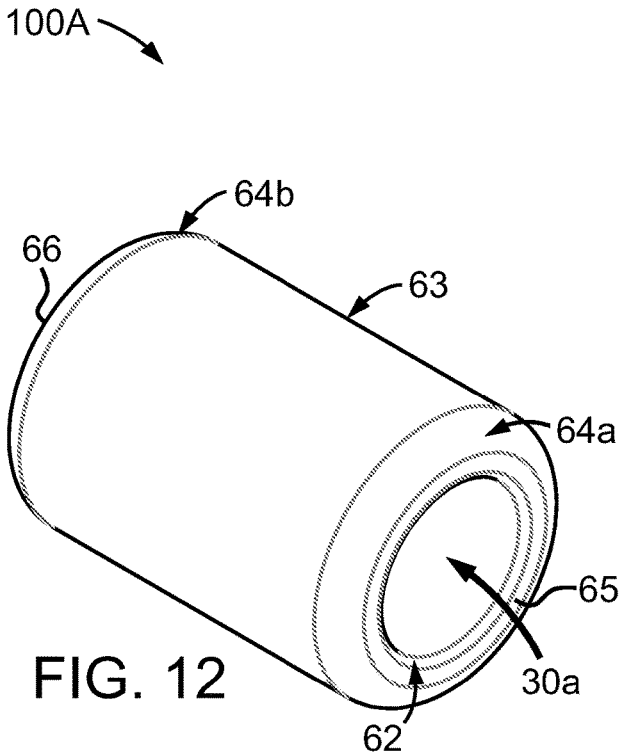
FIG. 12 is a perspective view of a first-step, initial core formation showing a central cavity and solid wall in its leading end prior to being inserted into a petal-forming die.
Figure 14:
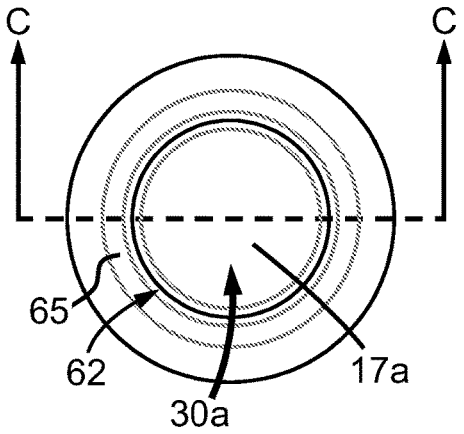
FIG. 14 is an end view of the first-step, initial core formation looking down into the central cavity in its leading end prior to being inserted into a petal-forming die.
Figure 13:
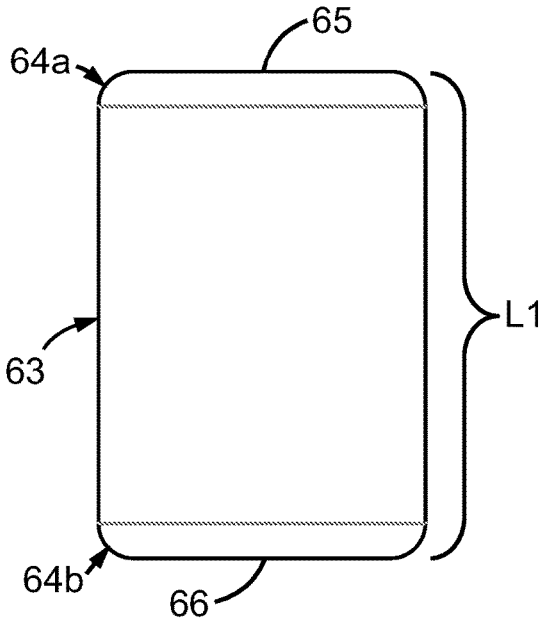
FIG. 13 is a side elevational view of the first-step initial core formation prior to being inserted into a petal-forming die.
Figure 15:
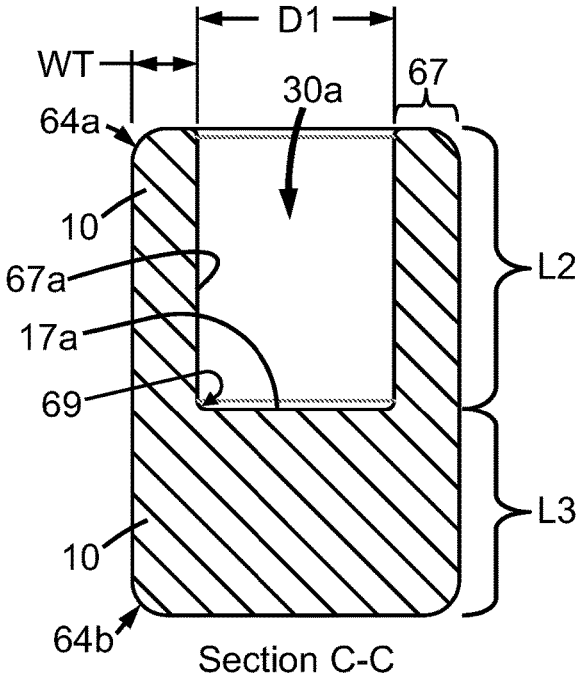
FIG. 15 is a section taken along line C-C of FIG. 14 showing a longitudinal cross-sectional view of the first-step, initial core formation prior to being inserted into a petal-forming die.
Figure 28:
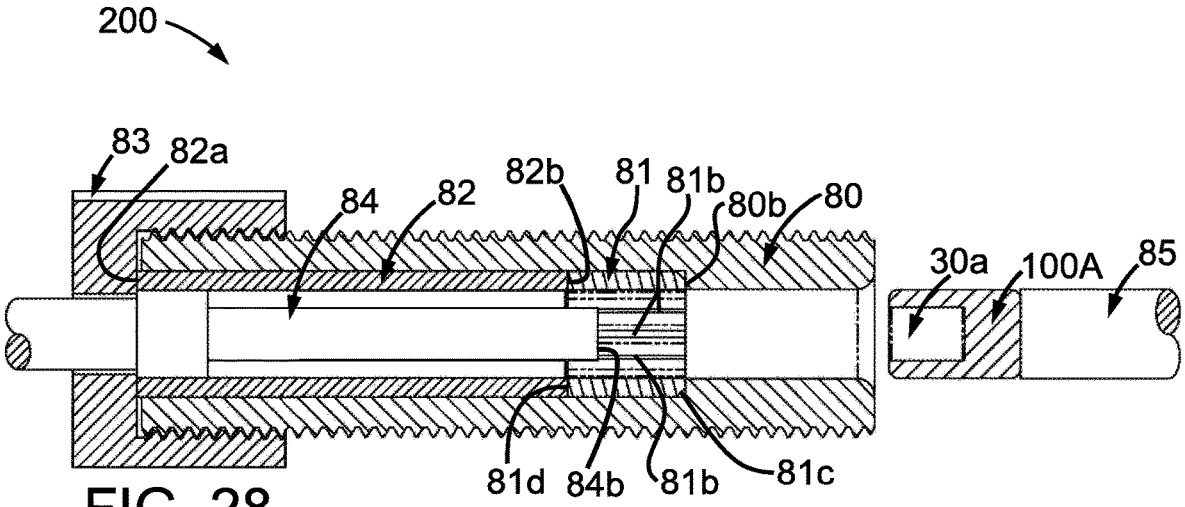
FIG. 28 is a view partly in section and partly in elevation showing a die, the punches and a dividing insert used to divide and thereafter form a series of petals in the open end of the first-step, initial core formation prior to its entry into the die.
Figure 29:
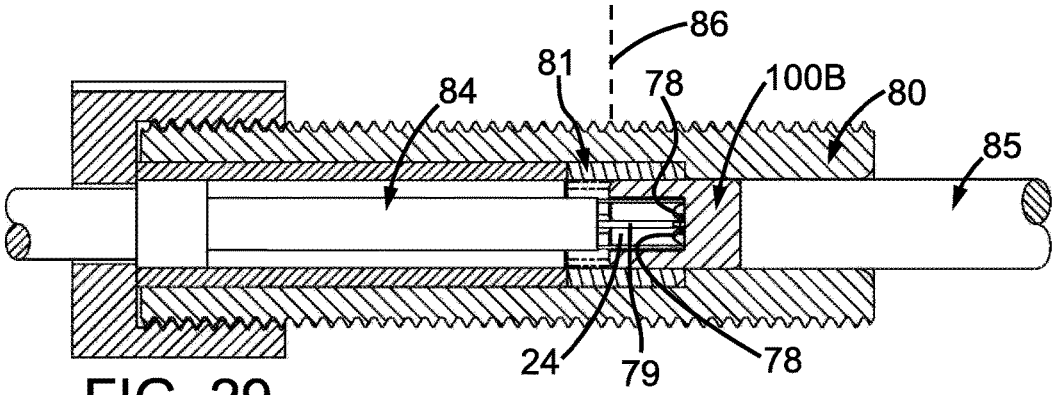
FIG. 29 is a view partly in section and partly in elevation showing a die, the punches and a dividing insert used to divide and thereafter form a series of petals in the open end of the first-step, initial core formation after the core has been forced into the die and the petals have been formed.
Figure 30:
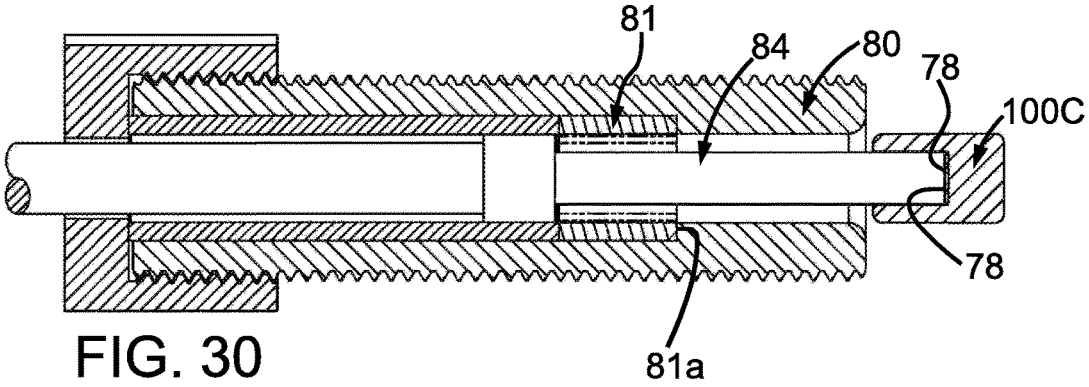
FIG. 30 is a view partly in section and partly in elevation showing a die, a dividing insert and the punches used to divide and thereafter form a series of petals in the open end of the first-step, initial core formation after the petals have been formed and after the core has been ejected from the die.

A preferred embodiment of the first-step, initial core formation used in the manufacture of bullet 100 is indicated generally as 100A in FIGS. 12-15. The first-step, initial core formation 100A illustrates the result of the first-step in the manufacturing process of the present bullet 100 and is shown in its initial state prior to subsequent modification in a petal-forming die 80 (FIGS. 28-30). A simple cylindrical die and a cavity-forming punch/knockout punch (not shown) can be used to form the first-step, initial core formation 100A from a bled-to-weight length of malleable wire or a bled-to-weight solid core (not shown). As an alternative to mechanically forming the first-step, initial core formation 100A, it can be injection molded or gravity cast. FIG. 12 is a perspective view of the first-step, initial core formation 100A having cylindrical portion 63, a front or leading end 65, and a rear or trailing end 66. The leading end 65 has an external radius 64*a*. The trailing end 66 has an external radius 64*b* as well, preferably of the same or similar size. The first-step, initial core formation 100A has a substantially cylindrical cavity 30*a* in its leading end 65. The cylindrical cavity 30*a* has an internal radius 62 which commences at its leading end 65. These radii (as well as radii present in any subsequent core formation) serve a purpose—which is to prevent excess plating buildup during the electroplating process. FIG. 13 is a side elevational view of the first-step, initial core formation 100A. The overall length L1 of the first-step, initial core formation 100A will vary depending on bullet caliber, the density of the core material 10, and the desired mass of the plated bullet 100. FIG. 14 is an end view of the first-step, initial core formation 100A looking down into the central cavity 30*a* in the leading end 65 of the first-step, initial core formation 100A. FIG. 15 is a section taken along line C-C of FIG. 14 showing a longitudinal cross-sectional view of the first-step, initial core formation 100A. Although the cavity 30*a* is substantially cylindrical, a small amount of draft can exist on the interior 67*a* of the wall 67 of the cavity 30*a* to aid in stripping the first-step, initial core formation 100A from a cavity-forming punch/knockout punch (not shown). The draft can extend from the inside radius 62 in the leading end 65 of the first-step, initial core formation 100A to an inside radius 69 near the bottom 17*a* of the cavity 30*a*. The inside diameter D1 of the cavity 30*a* will vary depending on the diameter of the bullet 100 and the use to which the bullet 100 is put. The wall thickness WT can also vary for the same reasons. The length L2 of the fore portion of the first-step, initial core formation 100A will vary depending on the desired mass of the bullet 100, as will the length of the solid aft portion L3.

Figure 23:
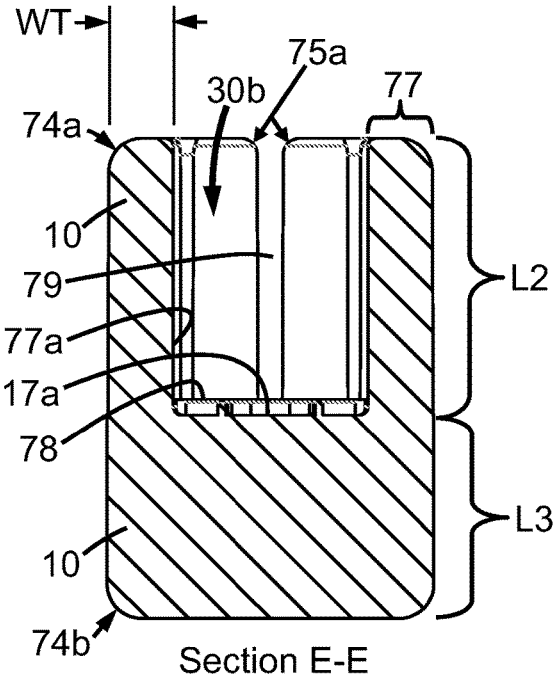
FIG. 23 is a section taken along line E-E of FIG. 22 showing a longitudinal cross-sectional view of the second-step core formation after it has been ejected from a petal forming die.

A second-step core formation relative to the manufacture of bullet 100 is indicated generally as 100B in FIGS. 16-19. The second-step core formation 100B has a substantially cylindrical cavity 30*b* and a surrounding wall 77 (FIG. 19) in its leading end 75 which is interrupted by a series of longitudinal air spaces 79 within the wall 77—the result of displaced wall material 78. The second-step core formation 100B is shown in this example after the first-step, initial core formation 100A has been forced into a petal-forming die (80, FIG. 29) containing a multi-armed dividing insert 81. Radial arms 81*b* in the multi-armed dividing insert 81 are designed to simultaneously form a series of longitudinal air spaces 79 and petals 24 as they divide the wall 77. As the first-step, initial core formation 100A is urged into the radial arms 81*b* of the multi-armed dividing insert 81 a specified distance (preferably the full length L2 of the wall 77), the displaced wall material 78 is forced downwardly and radially inwardly by the radial arms 81*b* where it is deposited at the bottom 17*a* of the cylindrical cavity 30*b* (FIG. 18, FIG. 19), ultimately resulting in the second-step core formation 100B shown. It should be understood that this second step is the most important step in the mechanical manufacturing process of the bullet 100—and it represents an unusual if not unique manufacturing approach as the general integrity of the uniform central cylindrical cavity 30*b* is maintained within the core material 10 at the same time individual petals 24 are formed. Importantly, it should likewise be understood that the only other way to make the second-step core formation 100B (other than mechanically forming a cold part) is to injection mold it or gravity cast it. Although molding a part consistent with the geometry of the second-step core formation 100B, is significantly more costly, molding can be considered a viable core forming option. It should be noted that the dividing step does not change the wall thickness WT of the first-step, initial core formation 100A to any meaningful degree. It should also be noted that different reference numbers are used herein to distinguish cavity 30*a* shown in FIGS. 12, 14 and 15 from cylindrical cavity 30*b* shown in FIGS. 16-19, FIGS. 20-23 and FIGS. 24-27. Cavity 30*a* has a continuous (uninterrupted) surrounding wall 67, whereas cylindrical cavity 30*b* has an interrupted surrounding wall 77 due to the presence of a series of longitudinal air spaces 79. It should likewise be noted that different reference numbers are used herein to distinguish the continuous (uninterrupted) surrounding wall 67 shown in FIG. 15 from the interrupted surrounding wall 77 shown in FIG. 19, FIG. 23 and FIG. 27. As an alternative to mechanically forming the second-step core formation 100B, it could be done by alternatively forming a cylindrical core having a central cylindrical cavity and an interrupted surrounding wall using an injection mold.

During the petal 24 forming process, the outside diameter 73*a* of the petal 24 group is slightly reduced in size (e.g., 0.001 to 0.002 of an inch) relative to the solid base or trailing diameter 73*b* as it assumes the slightly smaller inside diameter and undulating geometry of the multi-armed dividing insert 81 (FIGS. 31-34) after being urged into a petal-forming die 80, FIG. 29). The reduction in the outside diameter 73*a* of the petal 24 group ensures that the petals 24 are completely formed and smooth-walled, and that any eccentricity that exists (due to die system component tolerances) between the outside diameter 73*a* of the petal 24 group and the trailing diameter 73*b* is minimized. The reduction in the outside diameter 73*a* of the petal 24 group forms a step 73*c* (FIG. 17) between the outside diameter 73*a* and the trailing diameter 73*b*. Although the step 73*c* initially comprises a relatively sharp shoulder, its sharpness can be quickly removed during an optional core tumbling process. In this example, the width W3 of the longitudinal air space 79 represents 0.030 of an inch, however, the width W3 of the longitudinal air space 79, can be between 0.010 of an inch and 0.060 of an inch or wider if desired. While six longitudinal air spaces 79 and six petals 24 are shown, the second-step core formation 100B can have as few as three longitudinal air spaces 79 and three petals 24 or as many as eight or more of each. The finished bullet 100 can likewise have as few as three petals 24 or as many as eight or more. The optimum number of petals 24 in the bullet 100 for most law enforcement applications is generally six.

Figure 16:
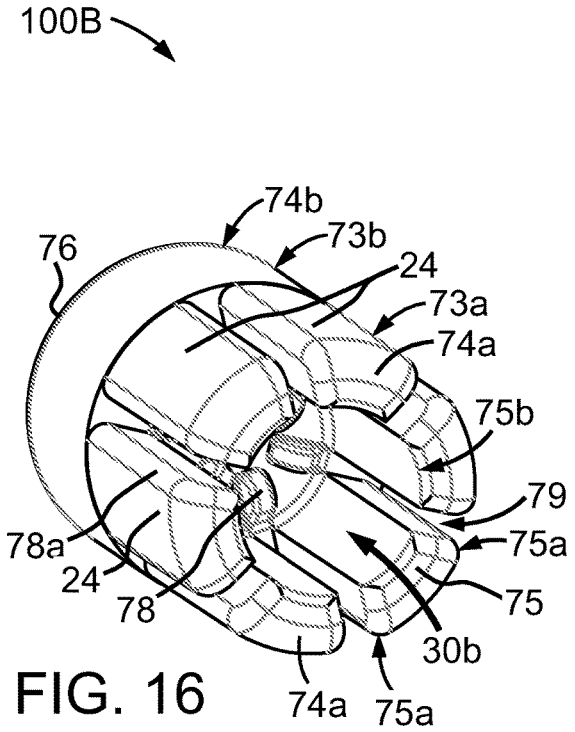
FIG. 16 is a perspective view of a second-step core formation after the first-step, initial core formation has been forced into a petal-forming die.
Figure 18:
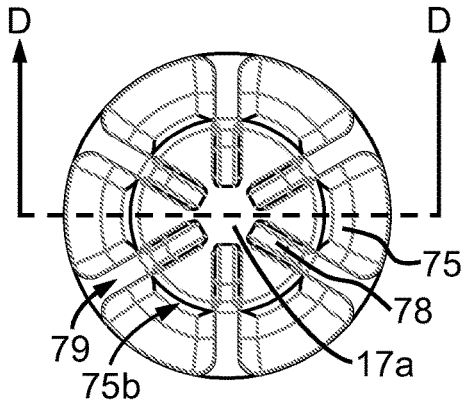
FIG. 18 is an end view of the second-step core formation looking down into the cavity in its leading end.
Figure 17:
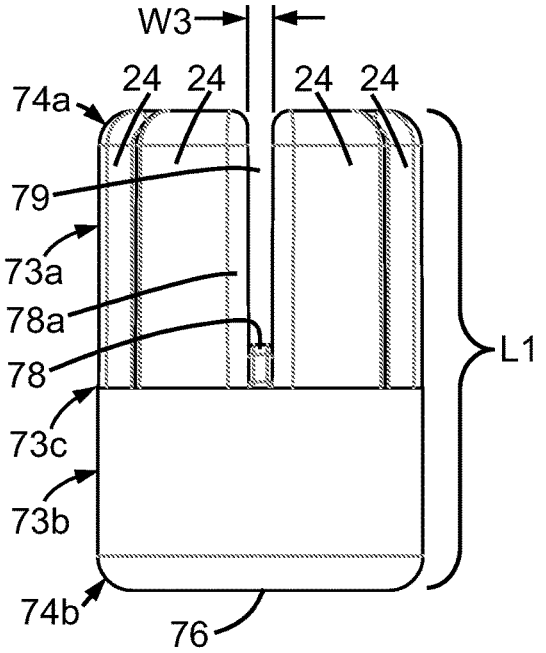
FIG. 17 is a side elevational view of the second-step core formation.
Figure 19:
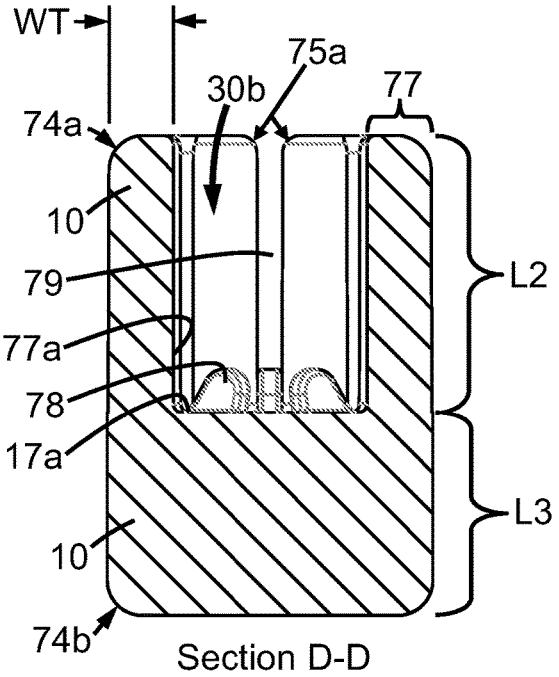
FIG. 19 is a section taken along line D-D of FIG. 18 showing a longitudinal cross-sectional view of the second-step core formation.
Figure 20:
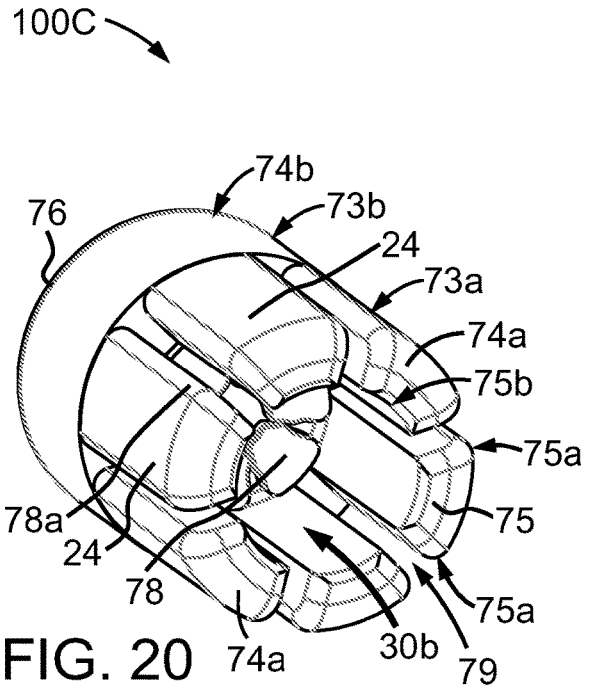
FIG. 20 is a perspective view of the second-step core formation after it has been ejected from a petal forming die by a flat-ended knockout punch.
Figure 22:
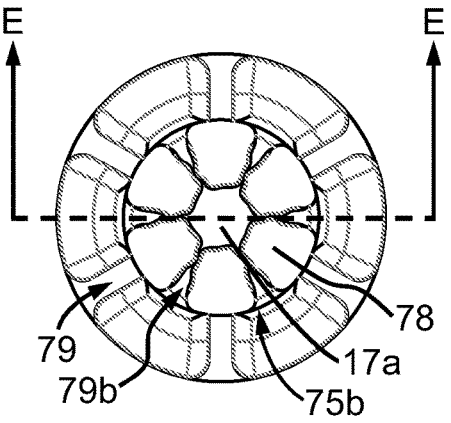
FIG. 22 is an end view of the second-step core formation shown in FIG. 20 looking down into the cavity in its leading end after it has been ejected from a petal forming die.
Figure 21:
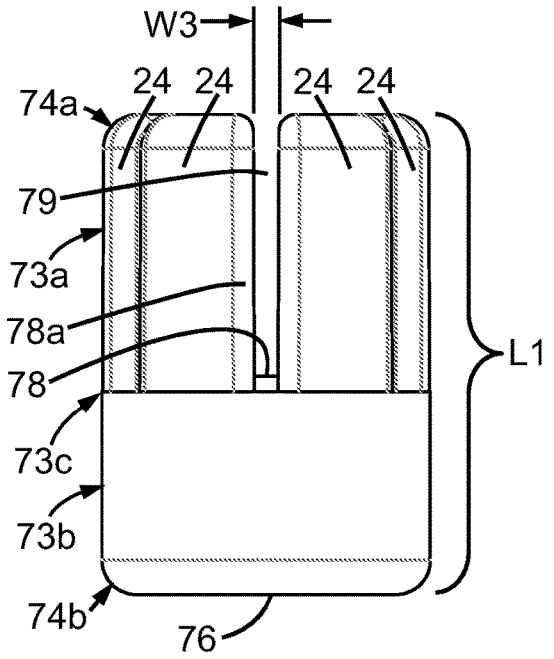
FIG. 21 is a side elevational view of the second-step core formation after it has been ejected from a petal forming die.

The displaced wall material 78 can assume various shapes depending on the hardness of the core material 10. The displaced wall material 78 is axially shortened and flattened by the flat-ended knockout punch 84 (FIGS. 28-30) as the second-step core formation 100B is ejected from the petal 24 forming die 80 which results in the ejected second-step core formation 100C. The axial height of the displaced wall material 78 prevents excessive penetration into the underlying core material 10 by the knockout punch 84 (FIGS. 28-30). FIG. 16 is a perspective view of the second-step core formation 100B having a front or leading end 75, and a rear or trailing end 76. The leading end 75 of each petal 24 has an external radius 74*a*. The trailing end 76 has an external radius 74*b* as well, preferably of the same or similar size. The cylindrical cavity 30*b* has an internal radius 75*b* which commences at the leading end 75 of each petal 24. Opposing pairs of external radii 75*a* also exist at the leading end 75 of each petal 24 and are formed as a natural consequence of the downward frictional drag applied to the core material 10 as the flat-ended radial arms (81*h*, FIG. 31) of the multi-armed dividing insert 81 penetrate the wall 77 during the petal 24 forming process. FIG. 17 is a side elevational view of the second-step core formation 100B. FIG. 17 shows a longitudinal radius 78*a* on either side of each petal 24 which runs along the entire length L1 of the surrounding wall 77. These longitudinal radii 78*a* are created by the internal geometry of the multi-armed dividing insert 81 during the petal 24 forming process. As previously intimated herein, these radii and others are desirable as they prevent excess plating buildup during the electroplating process. The overall length L1 of the second-step core formation 100B will vary depending on bullet caliber, the width W3 of the longitudinal air space 79, the density of the core material 10, and the desired mass of the plated bullet 100. The width W3 of the longitudinal air space 79 can vary depending on the desired plating thickness per side but in any case it must be initially wide enough to accommodate the desired plating thickness per side without causing any "bridging" of plating material that might connect one petal 24 surface to another—which could adversely fuse those petals 24 and ultimately interfere with the expandability of the bullet 100 on impact. The width W3 of the longitudinal air space 79 should be initially large enough to provide at least 0.010 an inch of air space between petals 24 after the plating is applied. This amount of after-plating air space generally ensures that adverse fusing between petals 24 does not occur. Depending on bullet caliber and plating thickness, the width W3 of the longitudinal air space 79 can be between about 0.010 inch and about 0.060 inch or wider if desired. The width W3 of the longitudinal air space 79 is contingent upon and controlled by the thickness of the flat ends (81*h*) of the radial arms (81*b*, FIG. 31) of the multi-armed dividing insert 81. FIG. 18 is an end view of the second-step core formation 100B looking down into the cylindrical cavity 30*b* in its leading end 75. While FIG. 18 shows the displaced wall material 78 having a width similar to the width W3 of the longitudinal air space 79, the displaced wall material 78 can widen and flow laterally as it is deposited at the bottom 17*a* of the cylindrical cavity 30*b*. The hardness of the core material 10 affects the ultimate width of the displaced core material 78. The softer the core 10 material, the wider the displaced wall material 78 deposited at the bottom 17*a* of the cylindrical cavity 30*b* will be. FIG. 19 is a section taken along line D-D of FIG. 18 showing a longitudinal cross-sectional view of the second-step core formation 100B. Although the cylindrical cavity 30*b* is generally cylindrical, a small amount of draft can exist on the interior wall 77*a* of the cylindrical cavity 30*b* to aid in stripping the second-step core formation 100B from the cavity-forming punch/knockout punch 84 (FIG. 28-30). The draft can extend from the inside radius 75*b* (FIGS. 16, 18) in the leading end 75 of the second-step core formation 100B to the bottom 17*a* (FIG. 18) of the cylindrical cavity 30*b*. The length L2 of the leading end 75 of the second-step core formation 100B will vary depending on the thickness of the flat ends (81*h*) of the radial arms 81*b* (FIG. 31) of the multi-armed dividing insert 81 and the desired mass of the bullet 100, as will the length L3 of the solid aft portion.

FIGS. 20-23, indicated generally as 100C show the second-step core formation 100B shown in FIGS. 16-19 after it has been ejected from a petal forming die 80 (FIGS. 28-30) by a flat-ended knockout punch 84. As the knockout punch 84 forces the second-step core formation 100B out of the a petal forming die 80, the flat end 84*b* of the knockout punch 84 bears against the displaced wall material 78, flattening and shortening it axially due to the frictional resistance offered by the radial arms 81*b* of the multi-armed dividing insert 81 held within the petal-forming die 80. This ejection action results in the ejected core 100C shown in FIGS. 20-23. It should be noted that the only significant difference between the first-step core formation 100B and the ejected core 100C is the flattened/displaced wall material 78. While the displaced wall material 78 is reduced in axial height, the overall length L1 of the second-step core formation 100C remains essentially unchanged, as does the length L2 of the wall 77 and the length L3 of the solid base portion. It should be noted that the flattening of the displaced wall material 78 does not materially change the wall thickness WT. The shape of the flattened/displaced wall material 78 can appear differently than that shown in FIG. 22. The final shape of the flattened/displaced wall material 78 ultimately depends on the malleability of the core material 10 used. Depending on the hardness of the core material 10, an air space 79*b* can exist between adjacent segments of flattened/displaced wall material 78. These air spaces 79*b* serve no critical function and form as a natural consequence of the wall material 78 being flattened axially and flowing laterally during the ejection process.

Figure 35:
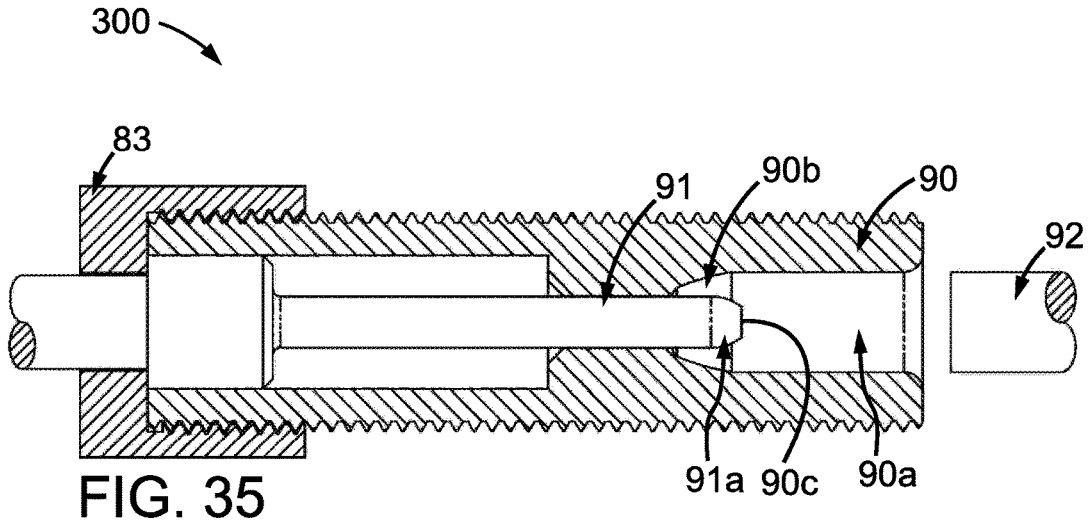
FIG. 35 is a view partly in section and partly in elevation showing an empty pointing die and the punches used to final form the hollow-point bullet of the present invention.
Figure 36:
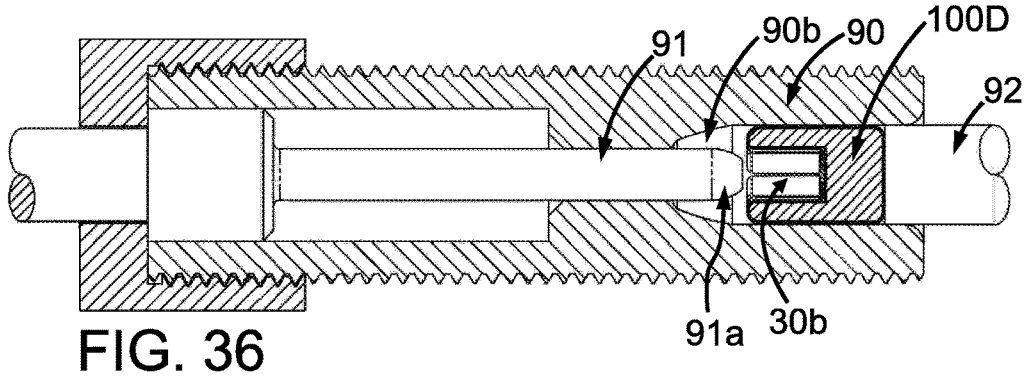
FIG. 36 is a view partly in section and partly in elevation showing a plated precursor forced part-way into the die prior to the front of the plated precursor engaging the ogive-forming portion of the die.
Figure 37:
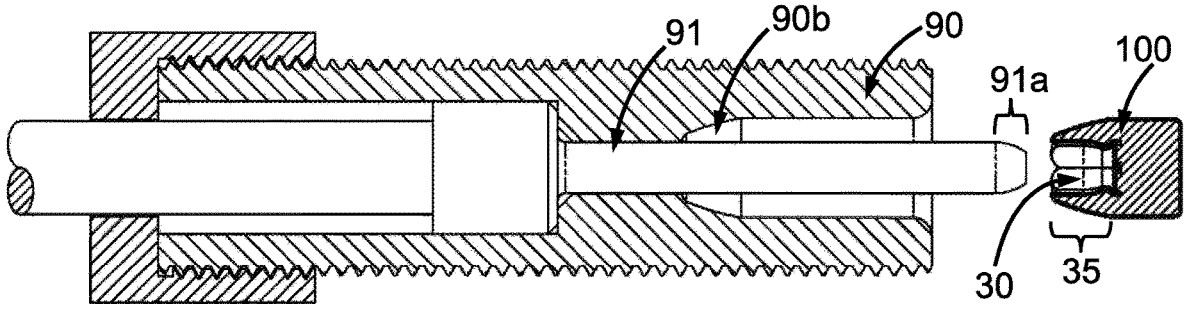
FIG. 37 is a view partly in section and partly in elevation showing the completely formed hollow-point bullet of the present invention after it has been ejected from the die.

FIGS. 24-27 show a plated precursor 100D after it has been electroplated during a third primary manufacturing step and will be referred to hereafter as the "plated precursor" 100D. The plated precursor 100D is essentially the ejected core 100C but after a plated jacket 15 has been applied to all internal and external surfaces. The plated precursor 100D represents the result of the manufacturing step (plating step) preceding the final forming step of the bullet 100 carried out in a pointing die 90 as shown in FIGS. 35-37.

Figure 24:
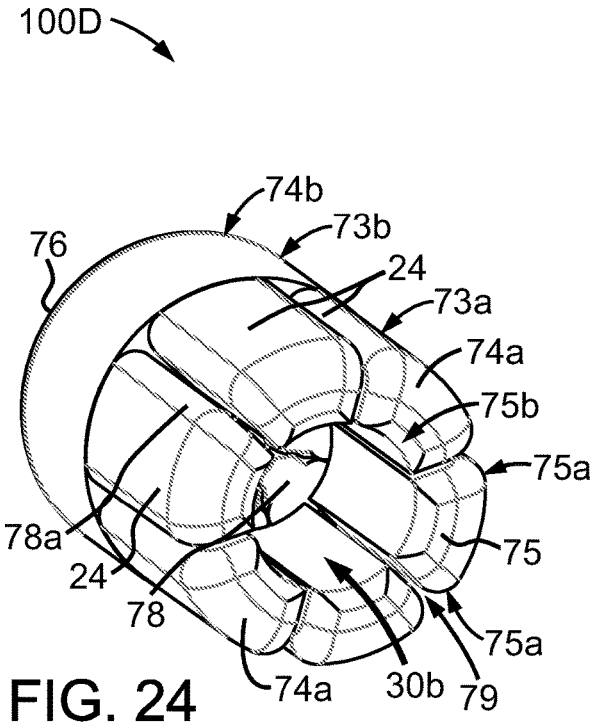
FIG. 24 is a perspective view of the plated precursor.
Figure 26:
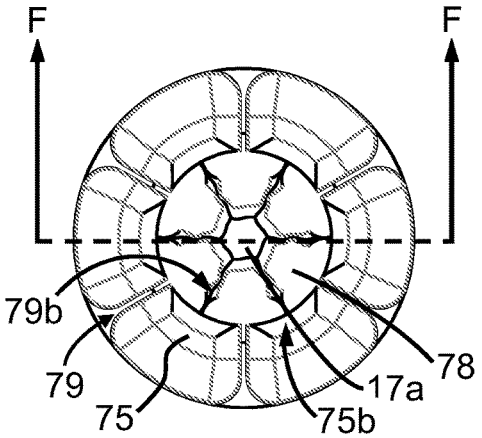
FIG. 26 is an end view of the plated precursor, looking down into the cavity in its leading end.
Figure 25:
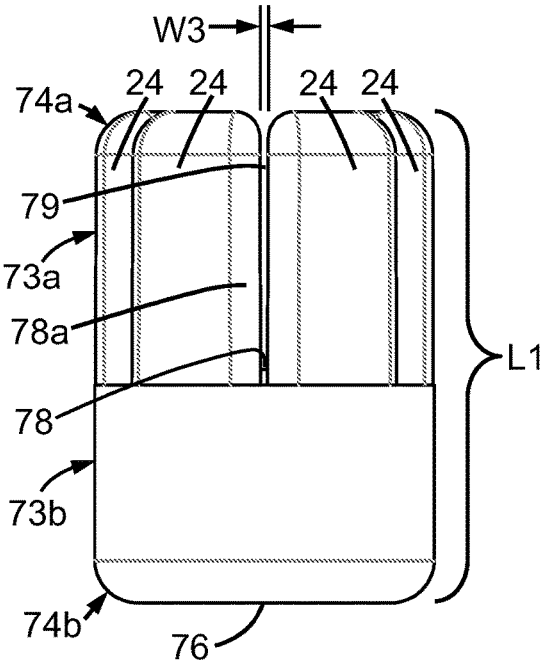
FIG. 25 is a side elevational view of the plated precursor.
Figure 27:
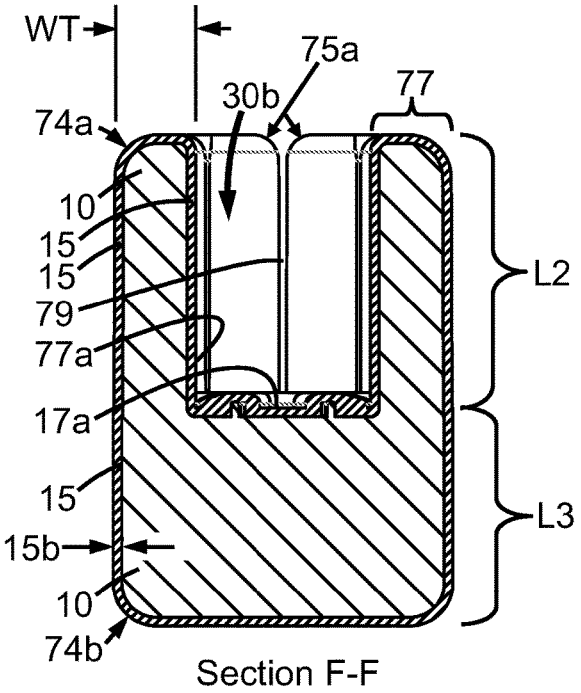
FIG. 27 is a section taken along line F-F of FIG. 26 showing a longitudinal cross-sectional view of the plated precursor.

FIG. 24 is a perspective view of the plated precursor 100D. As seen in FIG. 24 and in FIGS. 25-27, the width W3 of the longitudinal air space 79 separating the petals 24 has been substantially reduced as a result of the applied plating thickness 15*b*. In the example shown in FIGS. 20-23 (100C), the width W3 of the longitudinal air space 79 is approximately 0.030 of an inch. In the example shown in FIG. 27, approximately 0.010 of an inch of jacket 15 plating thickness 15*b* has been added to all internal and external surfaces of the plated precursor 100D, which, of course, includes adjacent surfaces of individual petals 24, subsequently resulting in a longitudinal air space 79 width W3 of approximately 0.010 of an inch. It should be noted that the application of plating has increased the wall thickness WT in this example by 0.020 of an inch and has increased the overall length L1 of the plated precursor 100D by 0.020 of an inch as well. FIG. 25 is a side elevational view of the plated precursor 100D clearly showing the reduced width W3 of the longitudinal air space 79. FIG. 26 is an end view of the plated precursor 100D, looking down into the cylindrical cavity 30*b* in its leading end 75. In this view, the air space 79*b* between adjacent segments of flattened/displaced wall material 78 is shown to be reduced in size as a result of the added plating thickness 15*b*. FIG. 27 is a section taken along line F-F of FIG. 26 showing a longitudinal cross-sectional view of the plated precursor 100D. FIG. 27 clearly shows the applied plating thickness 15*b* in this particular example. The plating thickness 15*b* can vary between 0.0035 of an inch and 0.030 of an inch—depending on the use to which the bullet 100 will be put.

A petal-forming die system used to form a series of petals in a malleable core constructed according to the principles of the present invention is indicated generally as 200 in FIGS. 28-30. It should be understood that the die and components shown in FIGS. 28-30 is used to divide the open end of a prototype core using a hand press. The configuration of a die for use in a high-speed manufacturing press can vary considerably from that shown without departing from the spirit of the manufacturing process.

FIG. 28 shows an empty, threaded petal-forming die 80 used to form both the second-step core formation 100B and the ejected second-step core formation 100C shown in FIGS. 16-19 and FIGS. 20-23. FIG. 28 shows the first-step, initial core formation 100A just prior to being inserted into the petal-forming die 80. The threaded die body 80 utilizes various components necessary to form the second-step core formation 100B and the ejected second-step core formation 100C; a multi-armed dividing insert 81 which forms both longitudinal air spaces 79 and petals 24 within the wall 67 of the first-step, initial core formation 100A; a retention sleeve 82, which, in combination with a threaded, hexagonal retainer cap 83, keeps the multi-armed dividing insert 81 securely in place; a flat-ended knockout punch 84 to eject the divided core after it is formed; and a base punch 85 which bears against the trailing end 66 of the first-step, initial core formation 100A as it forces it into the petal-forming die 80. The multi-armed dividing insert 81 is a crucial component which lies at the very heart of the manufacturing process. No other internal component geometry or mechanical process can be substituted to produce the results shown herein. The multi-armed dividing insert 81 is removable/replaceable and has a series of radial arms 81*b* which displace the core material 10 in the wall 67 of the first-step, initial core formation 100A. The front face 81*a* (FIG. 30) of the multi-armed dividing insert 81 has a chamfer 81*c* which ensures hard contact between it and an internal retention shoulder 80*b* inside the petal-forming die 80. This chamfer feature eliminates clearance between axial component surfaces and ultimately prevents any core material 10 from weeping between components and forming an undesirable buildup of core material 10 on the core surface. To ensure that internal die components are under axial compression, the interior surface of the tightened retention cap 83 presses against the rear face 82*a* of the retention sleeve 82 whereupon the front face 82*b* of the retention sleeve 82 presses against the rear face 81*d* of the multi-armed dividing insert 81, which in turn presses against an integral retention shoulder 80*b* inside the threaded petal-forming die 80.

FIG. 29 shows the second-step core formation 100B after it has been fully formed but is still held inside the multi-armed dividing insert 81. Due to space limitations in FIG. 29, limited reference lines are used. Reference lines point to a longitudinal air space 79, one of the formed petals 24 and two areas of displaced wall material 78. The axial length of the multi-armed dividing insert 81 is purposely built longer than necessary for functional reasons. It should be noted that the base punch 85 has only forced the second-step core formation 100B a specific distance (designated by broken line 86) into the multi-armed dividing insert 81. Stopping short of the full axial length of the multi-armed dividing insert 81 ensures that the second-step core formation 100B can be easily ejected from the multi-armed dividing insert 81.

FIG. 30 shows the ejected second-step core formation 100C after it has been ejected from the petal-forming die 80. The frictional resistance offered by the surface area of the radial arms 81*b* and the interior wall 81*g* of the multi-armed dividing insert 81 has caused the flat end 84*b* of the knockout punch 84 to axially shorten and substantially flatten the displaced wall material 78.

FIGS. 31-34 show an enlarged view of the multi-armed dividing insert 81 shown in FIGS. 28-30 and will be indicated generally as 81 in FIGS. 31-34. As intimated, the multi-armed dividing insert 81 is indispensable and lies at the heart of the manufacturing process. Without the specific internal geometry shown, a mechanical core dividing process capable of forming individual petals 24 having a longitudinal radius 78*a* running along the length L2 of each outer petal 24 edge would not be possible. These longitudinal radii 78*a* can be consistently formed because the core material 10 is held captive within the undulating geometry of the multi-armed dividing insert 81. Being trapped or contained in this way effectively prevents any radial growth of core material 10 and therefore any increase in the outside diameter 73*a* of the petal 24 group (FIGS. 16 and 17) as the wall 67 of the first-step, initial core formation 100A is penetrated by the radial arms 81*b* of the multi-armed dividing insert 81.

Figure 31:
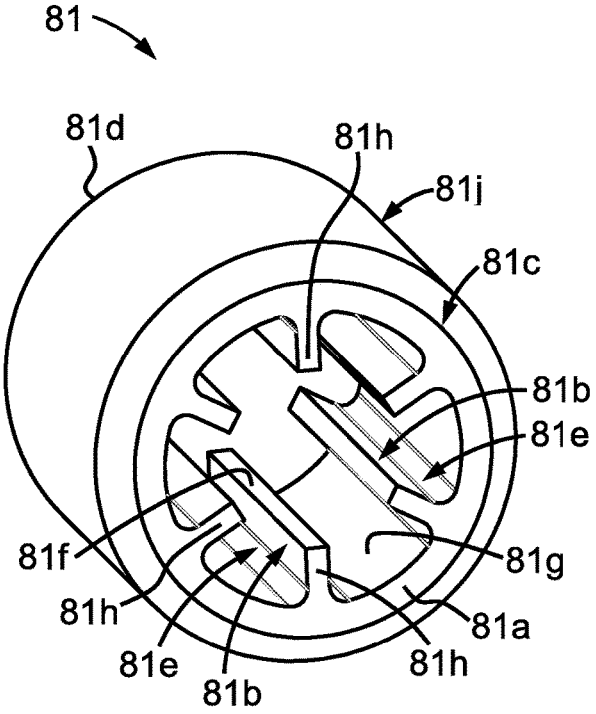
FIG. 31 is a perspective view of a multi-armed dividing insert used to divide the wall of the first-step, initial core formation into a series of petals.
Figure 33:
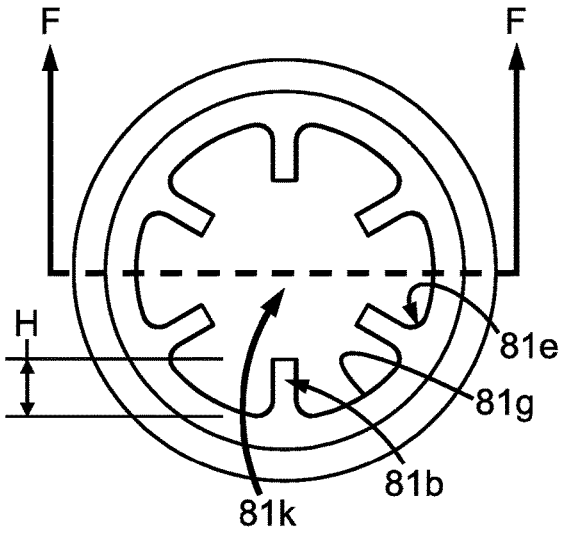
FIG. 33 is an end view of the multi-armed dividing insert looking down into its inlet end.
Figure 32:
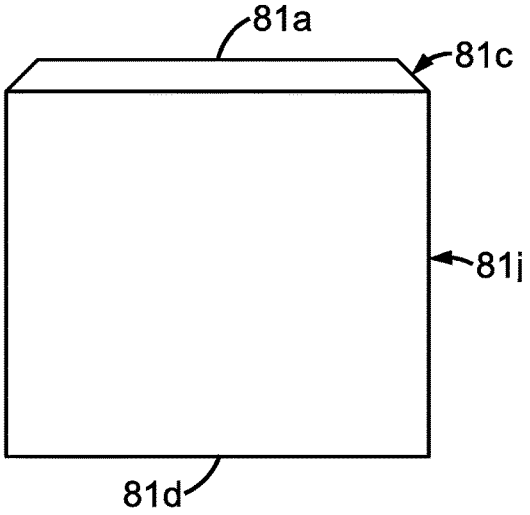
FIG. 32 is a side elevational view of the multi-armed dividing insert.
Figure 34:
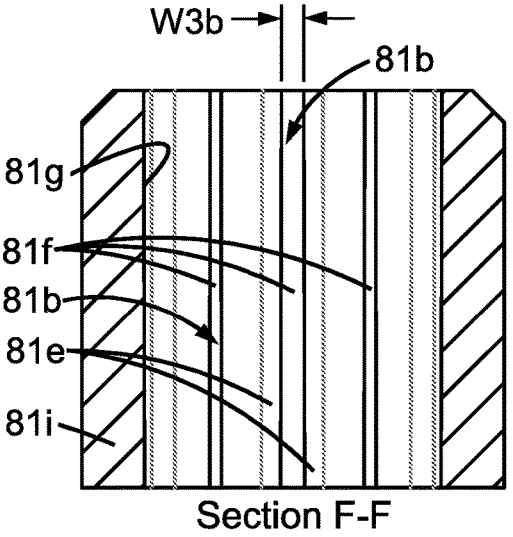
FIG. 34 is a section taken along line F-F of FIG. 33 showing a longitudinal cross-sectional view of a multi-armed dividing insert.

FIG. 31 is a perspective view of the multi-armed dividing insert 81. The multi-armed dividing insert 81 has a series of integral radial arms 81*b* extending inwardly from a solid outer wall 811 (FIG. 34) towards an open central area 81*k* (FIG. 33) inside the array of integral radial arms 81*b*. The multi-armed dividing insert 81 has a flat front face 81*a*, a chamfer 81*c* at its front face 81*a* (clearly shown in FIG. 32), a cylindrical section 81*j* and a rear face 81*d*. The radial arms 81*b* are generally parallel to one another, although a small amount of draft can exist along their length to minimize the expulsion force required to expel the second-step core formation 100B from the petal forming die 80. The interior wall 81*g* of the multi-armed dividing insert 81 can also have a degree of draft for the same reason but the draft will run in the opposite direction relative to that of the radial arms 81*b*. It is important to point out at this juncture that both sufficient draft and minimal surface roughness contribute to a reduction in expulsion force. The radial arms 81*b* of the multi-armed dividing insert 81 are wire EDM'd using a 5-axis EDM capable of producing draft on all surfaces of the radial arms 81*b*. A "rough cut" plus three, "skim cuts" of 0.0001 of an inch each are necessary to achieve a sufficiently smooth surface finish. The surface of the multi-armed dividing insert 81 can be further smoothed, however, by "electropolishing". Electropolishing is a process in which the EDM'd part is placed in an electro-chemical solution and an electric current is passed through a chemical bath. Electropolishing is the opposite of plating. Instead of applying material to the outside of the part, electropolishing removes a small amount of metal, resulting in a smoother surface. In addition to smoothing the part, the process removes all sharp edges.

The forward ends 81*h* of the radial arms 81*b* are flat at the front face 81*a* of the multi-armed dividing insert 81. The flat geometry is important and is responsible for cleanly and precisely displacing core material 10 and forcing it in a downward direction as the longitudinal air spaces 79 within the wall 77 and the resultant petals 24 are simultaneously formed. Sufficient arm width W3*b* (FIG. 34) is important as it controls the width W3 of the longitudinal air spaces 79 in the second-step core formation 100B which effectively prevents the occurrence of any adverse bridging of plating material 15 between petals 24. It should be pointed out at this juncture that, depending on the caliber and weight of the bullet 100 contemplated, the radial arms 81*b* can have a different thickness than that shown. A larger arm width W3*b*, for example, would produce a greater volume of displaced wall material 78 at the bottom 17*a* of the cylindrical cavity 30*b* in the second-step core formation 100B shown in FIG. 19. The reverse, of course, would be true for a smaller arm width W3*b*. A long, longitudinal radius 81*e* runs the entire length and on either side of each radial arm 81*b*. These radii 81*e* are vital as they prevent excess plating buildup on the exterior of the ejected second-step core formation 100C. Excess buildup of plating can adversely affect bullet performance on impact and severely detract from the aesthetics of the final plated bullet 100. The radial height "H" of the radial arms 81*b* in the multi-armed dividing insert 81 is critical as it needs to exceed the wall thickness WT of the first-step, initial core formation 100A shown in FIGS. 12-15. If the radial height H of the radial arms 81*b* is less than the wall thickness WT, a volume of undesirable flash can form along the length L2 of the petals 24 of the second-step core formation 100B which can affect the shape and uniformity of the petals 24. The radial height H of the radial arms 81*b* need only be a few thousandths of an inch longer than the wall thickness WT.

A pointing die system used to form a finished bullet constructed according to the principles of the present invention is indicated generally as 300 in FIGS. 35-37.

FIG. 35 shows an empty, threaded pointing die 90, a hollow-point-forming/knockout punch 91, a base punch 92 and a hex retainer cap 83. The threaded pointing die 90 shown in FIGS. 35-37 is used to form an ogive 35 on the front end of the plated precursor 100D as a base punch 92 forces the petals 24 of the plated precursor 100D into the ogive-forming area 90*b* of the profiled cavity 90*a* of the threaded pointing die 90 and around the profiled end 91*a* of the hollow-point-forming/knockout punch 91.

FIG. 36 shows the plated precursor 100D with its cylindrical cavity 30*b* as it is being inserted part-way into the profiled cavity 90*a* of the threaded pointing die 90. In this view, the plated precursor 100D is shown stopping short of engaging the ogive-forming area 90*b* of the profiled cavity 90*a*.

FIG. 37 shows the finished, fully-formed bullet 100 after it has been ejected from the threaded pointing die 90 by the hollow-point-forming/knockout punch 91. During the reformation process (reforming the petals of the plated precursor 100D), the swaging pressure achieved within the threaded pointing die 90 can exceed 30,000 psi. Under the influence of such high swaging pressure, the ogive-forming area 90*b* of the threaded pointing die 90 has formed an ogive 35 on the bullet 100 and forced the petals 24 into intimate contact with one another over at least a portion of their length and reshaped them as core 10 material has been rearranged within the plated jacket 15, constricting the petals 24 in some areas and literally 'inflating' the jacket 15 material in other areas. At the same time during the swaging process, a portion of the cylindrical cavity 30*b* of the plated precursor 100D has been reshaped to conform to the tapered tip 91*a* of the hollow-point-forming/knockout punch 91, resulting in the partially curved hollow-point cavity 30.

Figure 38:
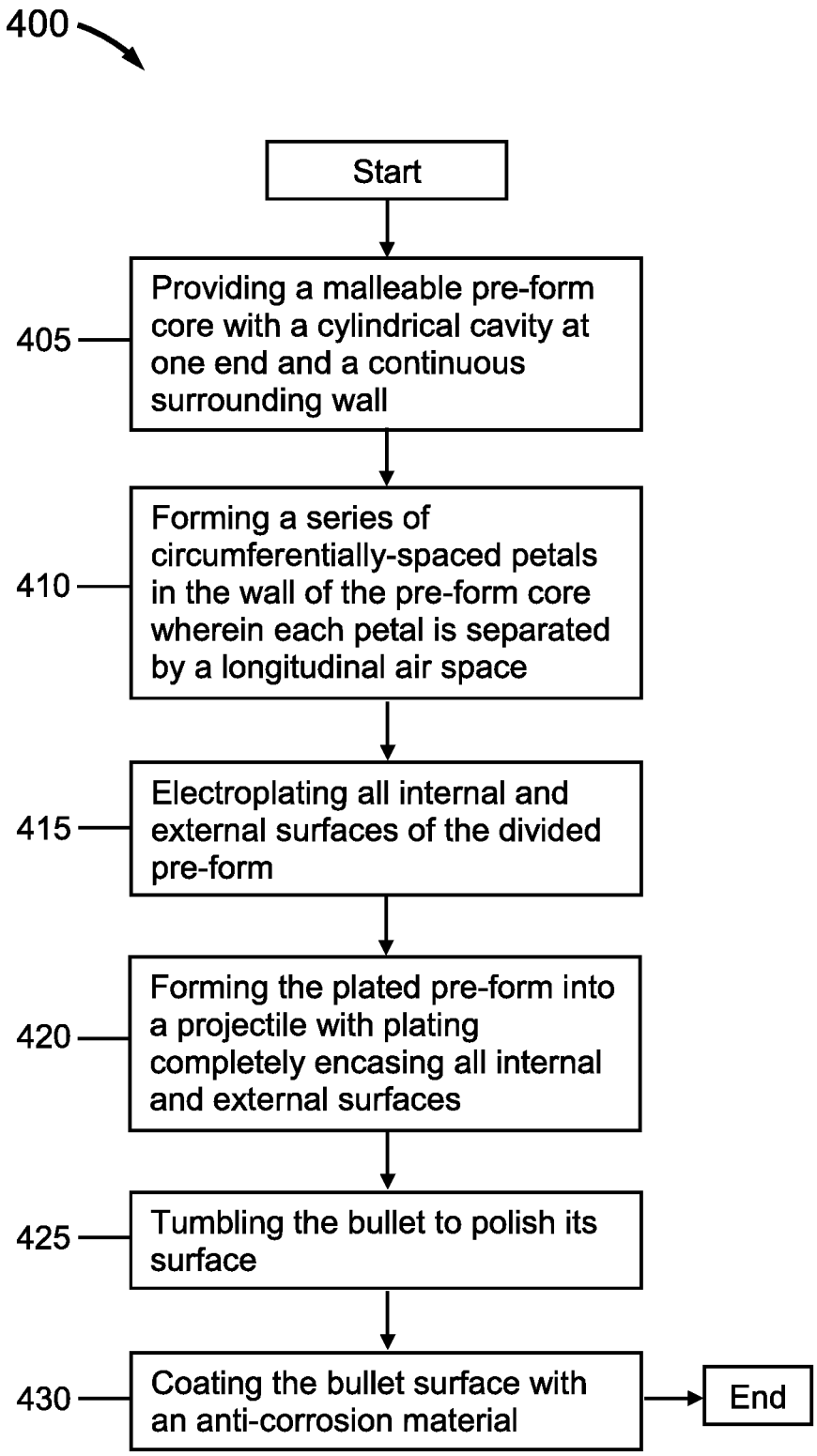
FIG. 38 Refers to a flowchart illustrating example steps in a method 400 of making a fully plated expanding projectile 100 in accordance with the present disclosure.

FIG. 38 Refers to a flowchart illustrating example steps in a method 400 of making a fully plated expanding projectile 100 in accordance with the present disclosure. Method 400 is discussed in detail above with references to FIGS. 12-37, which illustrate embodiments of projectile 100 in various stages of production as well as the tooling used in the associated manufacturing process.

What is claimed is:

1. A plated expanding bullet, comprising:

a core comprising a malleable material of a first hardness, the core having a nose and an aft;

a plurality of petals at least partially defining the nose of the core, wherein each petal is integrally formed and extending from a peripheral portion of the aft and taper inward such that the plurality of petals form a hollow-point cavity, each of the petals is independently bendable, each of the petals further comprising a first inflection point and a second inflection point wherein the second inflection point is positioned closest to the aft and is the thickest portion of the petal; and a bonded metal jacket of a second hardness completely encapsulating the core, each of the petals, and the hollow-point cavity and wherein the second hardness is greater than the first hardness.

2. The bullet of claim 1, the hollow-point cavity is frusto-conical.

3. The bullet of claim 1, the hollow-point cavity is cylindrical at a first end and curved at a second end.

4. The bullet of claim 1, wherein the aft comprises a base, wherein the base is truncated.

5. The bullet of claim 1, wherein the aft comprises a base, wherein the base is flat.

6. The bullet of claim 1, the core comprises between three and eight petals.

7. The bullet of claim 1, the jacket thickness being between 0.0035 inches and 0.030 inches.

8. The bullet of claim 1, the core being made of lead or lead alloy.

9. The bullet of claim 1, the core being made of tin, zinc, bismuth or alloys thereof.

10. A plated expanding bullet, comprising:

a core comprising a malleable material of a first hardness, the core having a nose and an aft;

a plurality of petals at least partially defining the nose of the core, wherein each petal is integrally formed and extending from a peripheral portion of the aft and taper inward such that the plurality of petals form a hollow-point cavity, each of the petals is independently bendable, each of the petals further comprising a first inflection point and a second inflection point wherein the second inflection point is positioned closest to the aft and is the thickest portion of the petal; and a bonded metal jacket of a second hardness completely encapsulating the core, each of the petals, and the hollow-point cavity and wherein the second hardness is greater than the first hardness, further wherein the jacket comprises a first thickness and a second thickness.

11. The bullet of claim 10, the hollow-point cavity is frusto-conical.

12. The bullet of claim 10, wherein the aft comprises a base, wherein the base is truncated.

13. The bullet of claim 10, the petals further comprise a base, and wherein the jacket encompassing the base of the petals is a second thickness.

14. A process having steps for forming a plated hollow-point expanding bullet, the steps comprising:

forming a cylindrical core having a central cylindrical cavity and a continuous surrounding wall at one end from a cylindrical core using a cavity-forming/knock-out punch;

swaging the cylindrical core to form a series of circumferentially-spaced petals in the wall of the core wherein each petal is formed using a petal-forming die containing a multi-armed dividing insert while simultaneously separating the petals by a longitudinal air space;

electroplating all internal and external surfaces of the divided pre-form; and forming the plated pre-form into a plated hollow-point expanding bullet with plating completely encasing all internal and external surfaces.

15. The process of claim 14, further comprising the step of alternatively forming a cylindrical core having a central cylindrical cavity and a continuous surrounding wall using an injection mold.

16. The process of claim 14, further comprising the step of alternatively forming a cylindrical core having a central cylindrical cavity and a continuous surrounding wall using a gravity cast.

17. The process of claim 14, further comprising the step of alternatively forming a cylindrical core having a central cylindrical cavity and an interrupted surrounding wall using an injection mold.

18. The process of claim 14, further comprising the step of chemically cleaning the core.

19. The process of claim 14, further comprising the step of tumbling the core to smooth stepped areas and/or create radii or enlarge existing radii.

20. The process of claim 14, further comprising the step of tumbling the bullet to polish its surface.

21. The process of claim 14, further comprising the step of coating the bullet surface with an anti-corrosion material.

* * * * *